US011286597B2

(12) United States Patent
Yamada et al.

(10) Patent No.: US 11,286,597 B2
(45) Date of Patent: Mar. 29, 2022

(54) SEWING MACHINE AND SEWING METHOD

(71) Applicant: JUKI CORPORATION, Tama (JP)

(72) Inventors: Kazunori Yamada, Tama (JP); Kimihiro Yokose, Tama (JP); Kouichi Kondou, Tama (JP); Takahiro Sano, Tama (JP)

(73) Assignee: JUKI CORPORATION, Tama (JP)

( * ) Notice: Subject to any disclaimer, the term of this patent is extended or adjusted under 35 U.S.C. 154(b) by 185 days.

(21) Appl. No.: 16/444,164

(22) Filed: Jun. 18, 2019

(65) Prior Publication Data

US 2019/0390383 A1 Dec. 26, 2019

(30) Foreign Application Priority Data

Jun. 20, 2018 (JP) ..... JP2018-116788

(51) Int. Cl.
*D05B 19/16* (2006.01)
*D05B 19/08* (2006.01)

(52) U.S. Cl.
CPC ..... *D05B 19/16* (2013.01); *D05B 19/08* (2013.01)

(58) Field of Classification Search
CPC ..... D05B 19/10; D05B 19/12; D05B 19/14; D05B 19/16; D05C 5/00; D05C 5/02; D05C 5/04; D05C 9/18; D05C 9/22; D05C 11/16
USPC ..... 700/135–138; 112/470.06
See application file for complete search history.

(56) References Cited

U.S. PATENT DOCUMENTS 6,098,559 A * 8/2000 Hirose ..... D05B 19/12 112/102.5
2011/0146553 A1* 6/2011 Wilhelmsson ..... D05C 9/06 112/475.19
2013/0112127 A1* 5/2013 Tokura ..... D05B 19/10 112/102.5
2017/0204547 A1 7/2017 Yoshida et al.
(Continued)

FOREIGN PATENT DOCUMENTS

CN 106995986 A 8/2017
CN 107034592 A 8/2017
(Continued)

OTHER PUBLICATIONS

English translation of JP5073597 (pub'd Nov. 14, 2012), obtained via epacenet.com (last visited Mar. 11, 2021) (Year: 2021).*
(Continued)

*Primary Examiner* — Alissa L Hoey
*Assistant Examiner* — Patrick J. Lynch
(74) *Attorney, Agent, or Firm* — Faegre Drinker Biddle & Reath LLP

(57) ABSTRACT

A sewing machine is disclosed. The sewing machine includes a holding member configured to be movable while holding a workpiece within a predetermined plane including a sewing position immediately below a needle, an actuator configured to move the holding member, an imaging device configured to be capable of capturing the workpiece, a sewing data acquisition unit configured to acquire sewing data including a sewing order to be referred to in sewing processing, and an imaging position setting unit configured to output a control signal to the actuator so that a plurality of feature patterns of the workpiece are sequentially disposed in an imaging region of the imaging device based upon the sewing data.

6 Claims, 20 Drawing Sheets

(56) References Cited

U.S. PATENT DOCUMENTS

| | | | | |
|---|---|---|---|---|
| 2017/0356112 | A1* | 12/2017 | Blenis, Jr | D05B 35/102 |
| 2018/0015859 | A1 | 1/2018 | Aida et al. | |
| 2018/0080155 | A1 | 3/2018 | Sano et al. | |
| 2018/0258568 | A1* | 9/2018 | Imaizumi | D05B 19/08 |

FOREIGN PATENT DOCUMENTS

| | | | | |
|---|---|---|---|---|
| CN | 107829221 | A | | 3/2018 |
| JP | 2010-016556 | A | | 1/2010 |
| JP | 5073597 | | * | 8/2012 |
| JP | 2013-162957 | A | | 8/2013 |
| JP | 2016-141297 | A | | 8/2016 |

OTHER PUBLICATIONS

First Office Action dated Dec. 20, 2021 in Chinese Patent Application No. 201910539665.0 (9 pages) with an English translation (11 pages).

* cited by examiner

FIG.20

(mm)

| HEIGHT | PIXEL RATE |
|---|---|
| h1 | 0.51 |
| h2 | 0.50 |
| h3 | 0.49 |

FIG.21

| PATTERN NUMBER | THICKNESS (mm) |
|---|---|
| 001 | 1 |
| 002 | 1.3 |
| 003 | 0.8 |
| ⋮ | ⋮ |
| 999 | |

SEWING MACHINE AND SEWING METHOD

CROSS-REFERENCE TO RELATED APPLICATIONS

The present application claims the benefit of priority of Japanese Patent Application No. 2018-116788, filed on Jun. 20, 2018, the content of which is incorporated herein by reference.

TECHNICAL FIELD

The present invention relates to a sewing machine and a sewing method.

BACKGROUND ART

In order to improve a design of a workpiece, there is a case where a stitch is formed on the workpiece. In JP-A-2013-162957 and JP-A-2016-141297, disclosed is a technology for forming a stitch on a skin material used for a vehicle seat.

The skin material used for the vehicle seat has a thickness and elasticity. When a stitch is formed on a workpiece having the thickness and the elasticity, the workpiece may shrink and a surface of the workpiece may be displaced. For example, when a second stitch is formed after a first stitch is formed based upon sewing data in which a target position at which the stitch is to be formed is determined in advance, it is desirable that the second stitch is formed at the target position of the workpiece depending on the displacement of a surface of the workpiece caused by the formation of the first stitch.

As a countermeasure for forming the stitch at the target position of the workpiece, it is conceivable that the surface of the workpiece is captured before sewing processing is performed, thereby detecting the displacement of the surface of the workpiece. In order to improve the detection accuracy of the displacement of the surface of the workpiece, it is desirable to accurately position the surface of the workpiece in an imaging region of an imaging device. Further, in order to improve the detection accuracy of the displacement of the surface of the workpiece, it is desired to appropriately capture the surface of the workpiece.

SUMMARY OF THE INVENTION

The present invention is to provide a sewing machine and a sewing method capable of improving the detection accuracy of displacement of a surface of a workpiece.

An aspect of the present invention is a sewing machine, comprising:

a holding member configured to be movable while holding a workpiece within a predetermined plane including a sewing position immediately below a needle;

an actuator configured to move the holding member;

an imaging device configured to be capable of capturing the workpiece;

a sewing data acquisition unit configured to acquire sewing data including a sewing order to be referred to in sewing processing; and an imaging position setting unit configured to output a control signal to the actuator so that a plurality of feature patterns of the workpiece are sequentially disposed in an imaging region of the imaging device based upon the sewing data.

Another aspect of the present invention is a sewing machine, comprising:

a holding member configured to be movable while holding a workpiece within a predetermined plane including a sewing position immediately below a needle;

an actuator configured to move the holding member;

an imaging device configured to be capable of capturing the workpiece;

an illumination device configured to illuminate the workpiece captured by the imaging device;

an illumination operation panel configured to be capable of receiving an operation related to the illumination device; and an illumination setting unit configured to output a control signal for controlling a light amount of the illumination device depending on the color of a surface of the workpiece based upon an operation with respect to the illumination operation panel.

Another aspect of the present invention is a sewing method, comprising:

capturing, by an imaging device, a workpiece held by a holding member which is movable within a predetermined plane including a sewing position immediately below a needle;

acquiring sewing data including a sewing order to be referred to in sewing processing; and outputting a control signal to an actuator which moves the holding member so that a plurality of feature patterns of the workpiece are sequentially disposed in an imaging region of the imaging device based upon the sewing data.

Another aspect of the present invention is a sewing method, comprising:

capturing, by an imaging device, a workpiece held by a holding member which is movable within a predetermined plane including a sewing position immediately below a needle;

receiving, by an illumination operation panel, an operation with respect to an illumination device which illuminates the workpiece captured by the imaging device; and outputting a control signal for controlling a light amount of the illumination device depending on the color of a surface of the workpiece based upon an operation with respect to the illumination operation panel.

According to each of the aspects of the present invention, it is possible to improve the detection accuracy of displacement of a surface of a workpiece.

BRIEF DESCRIPTION OF DRAWINGS

FIG. 20 is a view illustrating an example of a pixel rate with respect to a height;

FIG. 21 is a view illustrating an example of the height of the workpiece defined for each pattern;

DETAILED DESCRIPTION

Hereinafter, embodiments of the present invention will be described with reference to the accompanying drawings, but the present invention is not limited thereto. Components of the embodiments which will be described hereinafter can be appropriately combined with each other. Further, there is also a case where a part of the components may not be used.

First Embodiment

In the embodiment, a local coordinate system (hereinafter, refer to as a "sewing machine coordinate system") is defined for a sewing machine 1. The sewing machine coordinate system is defined by an XYZ orthogonal coordinate system. In the embodiment, a positional relationship of each unit will be described based upon the sewing machine coordinate system. A direction parallel to an X axis within a predetermined plane is defined as an X-axis direction. A direction parallel to a Y axis within the predetermined plane orthogonal to the X axis is defined as a Y-axis direction. A direction parallel to a Z axis orthogonal to the predetermined plane is defined as a Z-axis direction. Further, in the embodiment, a plane including the X axis and the Y axis is referred to as an XY plane. A plane including the X axis and the Z axis is referred to as an XZ plane. A plane including the Y axis and the Z axis is referred to as an YZ plane. The XY plane is parallel to a predetermined plane. The XY plane, the XZ plane, and the YZ plane are orthogonal to each other. Further, in the embodiment, the XY plane and a horizontal plane are parallel to each other. The Z-axis direction is an upward-and-downward direction. A +Z direction is an upward direction and a −Z direction is a downward direction. Further, the XY plane may be inclined with respect to the horizontal plane.

Figure 1:
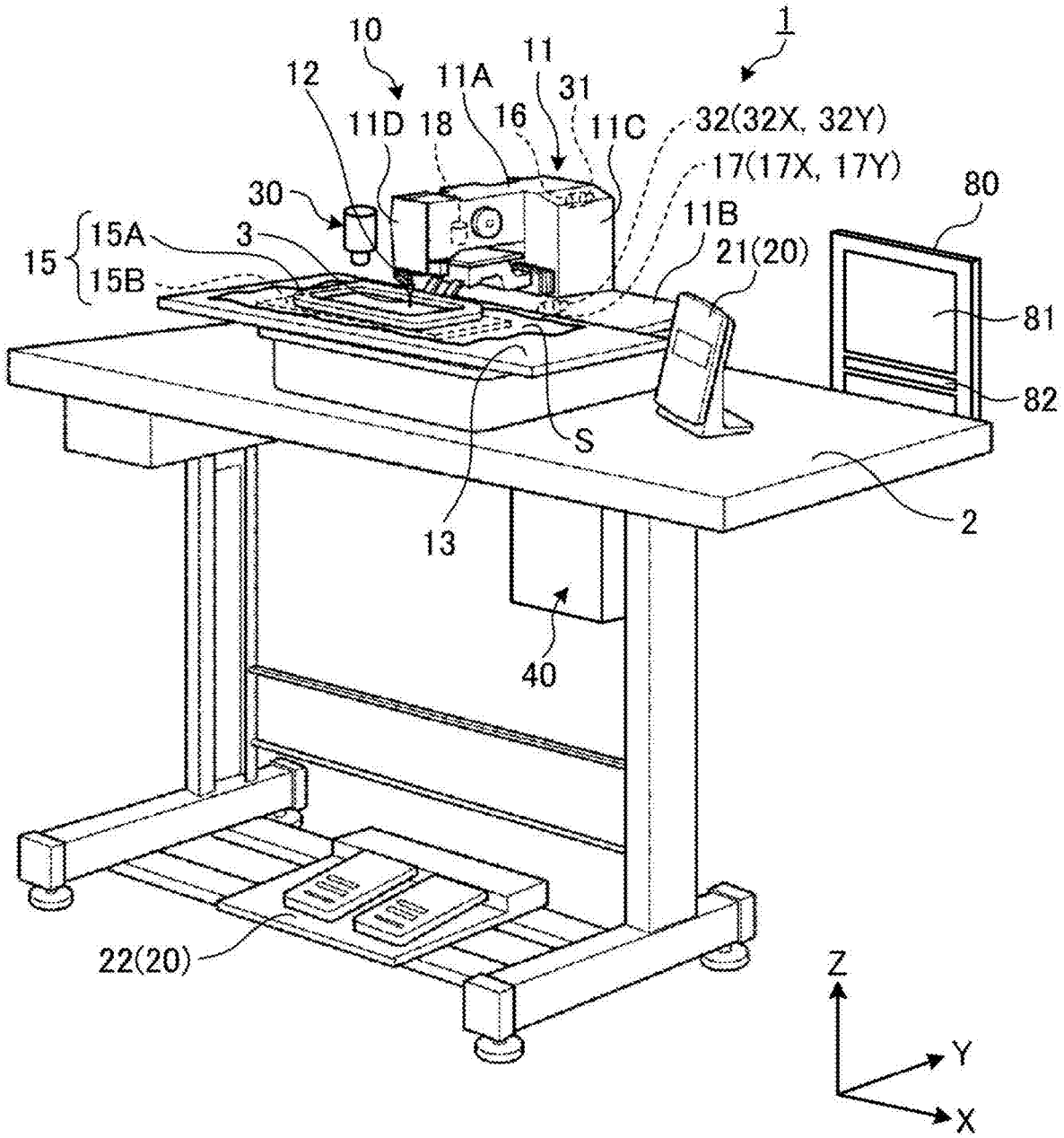
FIG. 1 is a perspective view illustrating an example of a sewing machine according to a first embodiment.
Figure 2:
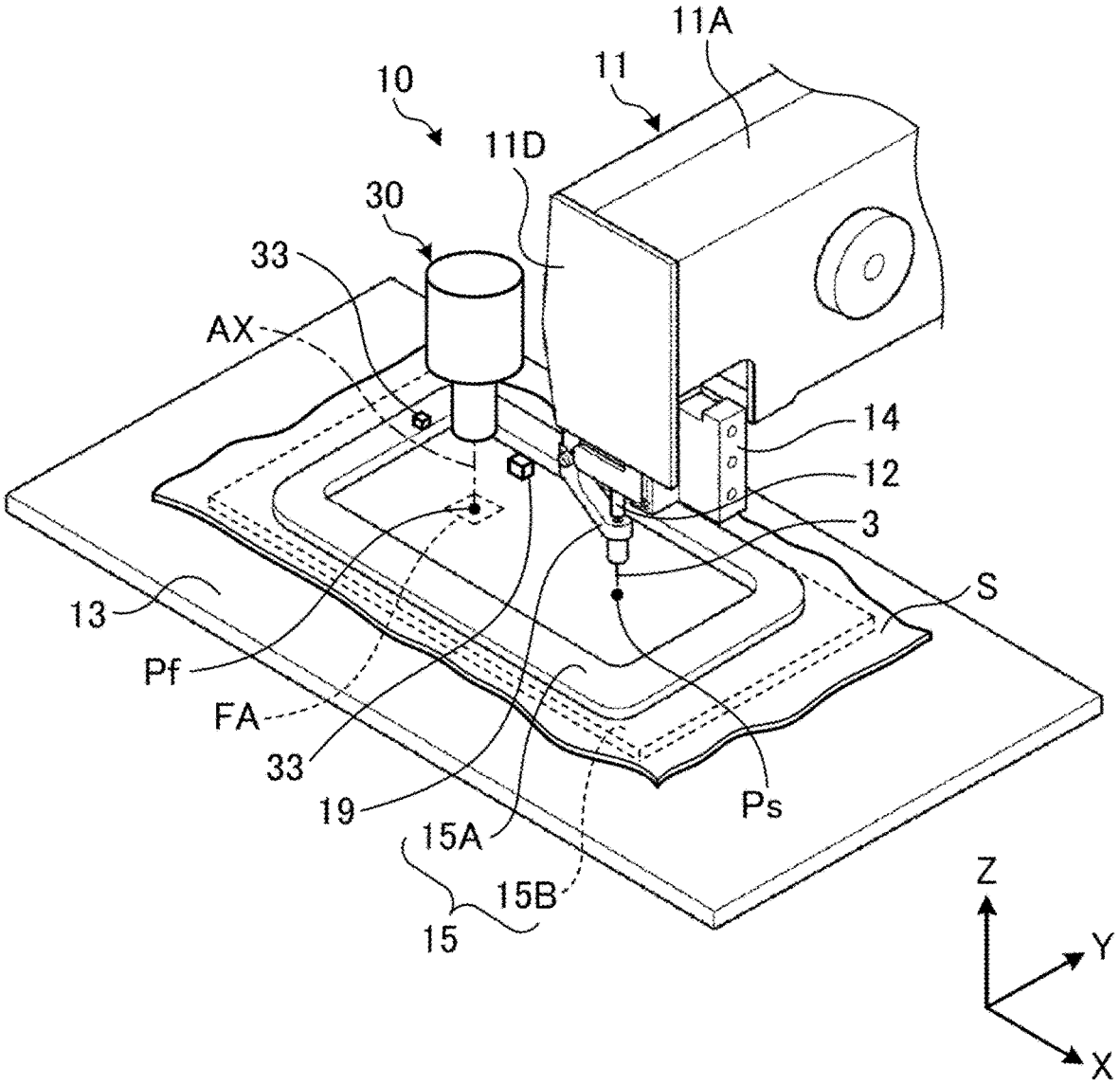
FIG. 2 is a perspective view illustrating a part of the sewing machine according to the first embodiment.

The sewing machine 1 will be described with reference to FIGS. 1 and 2. FIG. 1 is a perspective view illustrating an example of the sewing machine 1 according to the embodiment. FIG. 2 is a perspective view illustrating a part of the sewing machine 1 according to the embodiment. In the embodiment, the sewing machine 1 is an electronic cycle sewing machine. The sewing machine 1 includes a sewing machine main body 10, an operation device 20 operated by an operator, an imaging device 30 capable of capturing a workpiece S, a display device 80, and a control device 40 which controls the sewing machine 1.

The sewing machine main body 10 is mounted on an upper surface of a table 2. The sewing machine main body 10 includes a sewing machine frame 11, a needle bar 12 supported by the sewing machine frame 11, a throat plate 13 supported by the sewing machine frame 11, a holding member 15 supported by the sewing machine frame 11 via a supporting member 14, an actuator 16 which generates power for moving the needle bar 12, an actuator 17 which generates power for moving the holding member 15, and an actuator 18 which generates power for moving at least a part of the holding member 15.

The sewing machine frame 11 includes a horizontal arm 11A which extends in the Y-axis direction, a bed 11B disposed below the horizontal arm 11A, a vertical arm 11C which links an end part on the +Y side of the horizontal arm 11A to the bed 11B, and a head 11D disposed on the −Y side of the horizontal arm 11A.

The needle bar 12 holds a needle 3. The needle bar 12 holds the needle 3 so that the needle 3 and the Z axis are parallel to each other. The needle bar 12 is supported by the head 11D which is movable in the Z-axis direction.

The throat plate 13 supports the workpiece S. The throat plate 13 supports the holding member 15. The throat plate 13 is supported by the bed 11B. The throat plate 13 is disposed below the holding member 15.

The holding member 15 holds the workpiece S. The holding member 15 can move while holding the workpiece S within the XY plane including a sewing position Ps immediately below the needle 3. The holding member 15 can move while holding the workpiece S within the XY plane including an imaging position Pf of the imaging device 30. A stitch GP is formed on the workpiece S in such a manner that the holding member 15 moves within the XY plane including the sewing position Ps based upon sewing data which will be described later in a state where the holding member 15 holds the workpiece S. The holding member 15 is supported by the horizontal arm 11A via the supporting member 14.

The holding member 15 includes a pressing member 15A and a lower plate 15B which are disposed to be opposite to each other. The pressing member 15A is a frame-shaped member and is movable in the Z-axis direction. The lower plate 15B is disposed below the pressing member 15A. The holding member 15 holds the workpiece S by sandwiching the workpiece S between the pressing member 15A and the lower plate 15B.

When the pressing member 15A moves in the +Z direction, the pressing member 15A and the lower plate 15B are separated from each other. Accordingly, an operator can dispose the workpiece S between the pressing member 15A and the lower plate 15B. When the pressing member 15A moves in the −Z direction in a state where the workpiece S is disposed between the pressing member 15A and the lower plate 15B, the workpiece S is sandwiched between the pressing member 15A and the lower plate 15B. Accordingly, the workpiece S is held by the holding member 15. In addition, as the pressing member 15A moves in the +Z direction, holding of the workpiece S by the holding member 15 is released. Accordingly, the operator can take out the workpiece S from between the pressing member 15A and the lower plate 15B.

The actuator 16 generates power for moving the needle bar 12 in the Z-axis direction. The actuator 16 includes a pulse motor. The actuator 16 is disposed in the horizontal arm 11A.

A horizontal arm shaft which extends in the Y-axis direction is disposed on the inside of the horizontal arm 11A. The actuator 16 is connected to the end part on the +Y side of the horizontal arm shaft. An end part on the −Y side of the horizontal arm shaft is connected to the needle bar 12 via a power transmission mechanism disposed on the inside of the head 11D. The operation of the actuator 16 causes the horizontal arm shaft to rotate. The power generated by the actuator 16 is transmitted to the needle bar 12 via the horizontal arm shaft and the power transmission mechanism. Accordingly, the needle 3 held by the needle bar 12 moves so as to reciprocate in the Z-axis direction.

A timing belt which extends in the Z-axis direction is disposed on the inside of the vertical arm 11C. In addition, a bed shaft which extends in the Y-axis direction is disposed on the inside of the bed 11B. A pulley is disposed on each of the horizontal arm shaft and the bed shaft. The timing belt is wound around a pulley disposed on the horizontal arm shaft and the pulley disposed on the bed shaft, respectively. The horizontal arm shaft and the bed shaft are connected to each other via the power transmission mechanism including the timing belt.

A shuttle is disposed on the inside the bed 11B. A bobbin inputted into a bobbin case is accommodated in the shuttle. The operation of the actuator 16 causes each of the horizontal arm shaft and the bed shaft to rotate. The power generated by the actuator 16 is transmitted to the shuttle via the horizontal arm shaft, the timing belt, and the bed shaft. Accordingly, the shuttle rotates in synchronization with a reciprocating movement of the needle bar 12 in the Z-axis direction.

The actuator 17 generates power for moving the holding member 15 within the XY plane. The actuator 17 includes a pulse motor. The actuator 17 includes an X-axis motor 17X which generates power for moving the holding member 15 in the X-axis direction and a Y-axis motor 17Y which generates power for moving the holding member 15 in the Y-axis direction. The actuator 17 is disposed on the inside of the bed 11B.

The power generated by the actuator 17 is transmitted to the holding member 15 via the supporting member 14. Accordingly, the holding member 15 can move in each of the X-axis direction and the Y-axis direction between the needle 3 and the throat plate 13. By the operation of the actuator 17, the holding member 15 can move while holding the workpiece S within the XY plane including the sewing position Ps immediately below the needle 3.

The actuator 18 generates power for moving the pressing member 15A of the holding member 15 in the Z-axis direction. The actuator 18 includes a pulse motor. As the pressing member 15A moves in the +Z direction, the pressing member 15A and the lower plate 15B are separated from each other. As the pressing member 15A moves in the −Z direction, the workpiece S is sandwiched between the pressing member 15A and lower plate 15B.

As illustrated in FIG. 2, the sewing machine main body 10 includes an intermediate pressing member 19 disposed around the needle 3. The intermediate pressing member 19 presses the workpiece S around the needle 3. The intermediate pressing member 19 is supported by the head 11D movably in the Z-axis direction. On the inside of the head 11D, an intermediate pressing motor which generates power for moving the intermediate pressing member 19 in the Z-axis direction is disposed. By the operation of the intermediate pressing motor, the intermediate pressing member 19 moves in the Z-axis direction in synchronization with the needle bar 12. The intermediate pressing member 19 suppresses floating of the workpiece S caused by the movement of the needle 3.

The operation device 20 is operated by an operator. When the operation device 20 is operated, the sewing machine 1 operates. In the embodiment, the operation device 20 includes an operation panel 21 and an operation pedal 22.

The operation panel 21 includes: a display device including a flat panel display such as a liquid crystal display (LCD) or an organic electroluminescence (EL) display (OELD); and an input device which generates input data by being operated by the operator. The input device of the operation panel 21 can receive an operation related to sewing processing. In the embodiment, the input device includes a touch sensor disposed on the display screen of the display device. In other words, in the embodiment, the operation panel 21 includes a touch panel having a function of the input device. The operation panel 21 is mounted on the upper surface of the table 2. The operation pedal 22 is disposed below the table 2. The operator operates the operation pedal 22 with the foot. As at least one of the operation panel 21 and the operation pedal 22 is operated by the operator, the sewing machine 1 operates.

The imaging device 30 captures the workpiece S being held by the holding member 15. The imaging device 30 includes an optical system and an image sensor which receives incident light through the optical system. The image sensor includes a couple charged device (CCD) image sensor or a complementary metal oxide semiconductor (CMOS) image sensor.

The imaging device 30 is disposed above the throat plate 13 and the holding member 15. An imaging region FA is defined in the imaging device 30. The imaging region FA includes a field of view region of the optical system of the imaging device 30. The imaging region FA is defined immediately below the imaging device 30. The imaging region FA includes a position of an optical axis AX of the optical system of the imaging device 30. The imaging device 30 acquires at least a part of the image data of the workpiece S disposed in the imaging region FA. The imaging device 30 captures at least a part of the workpiece S disposed on the inside of the pressing member 15A from above.

The position of the imaging device 30 is fixed. A relative position between the imaging device 30 and the sewing machine frame 11 is fixed. A relative position between the optical axis AX of the optical system of the imaging device 30 and the needle 3 within the XY plane is fixed. Relative position data indicating the relative position between the optical axis AX of the optical system of the imaging device 30 and the needle 3 within the XY plane is known data that can be derived from design data of the sewing machine 1.

Further, in a case where there is a difference between the actual position of the imaging device 30 and the position in the design data due to a mounting error of the imaging device 30, after mounting the imaging device 30, by measuring the position of the needle 3 within the XY plane, moving the measured position of the needle 3 toward the imaging device 30 by the known data, and by measuring the difference between the actual position of the imaging device 30 within the XY plane and the position of the needle 3 after the movement, it is possible to calculate an accurate relative position between the optical axis AX of the optical system of the imaging device 30 and the needle 3 based upon the measurement result of the difference therebetween.

Further, the sewing machine 1 includes a driving amount sensor 31 which detects a driving amount of the actuator 16 and a driving amount sensor 32 which detects a driving amount of the actuator 17.

The driving amount sensor 31 includes an encoder which detects a rotation amount of the pulse motor which is the actuator 16. Detection data of the driving amount sensor 31 is outputted to the control device 40.

The driving amount sensor 32 includes an X-axis sensor 32X which detects a rotation amount of the X-axis motor 17X and a Y-axis sensor 32Y which detects a rotation amount of the Y-axis motor 17Y. The X-axis sensor 32X includes an encoder which detects the rotation amount of the X-axis motor 17X. The Y-axis sensor 32Y includes an encoder which detects the rotation amount of the Y-axis motor 17Y. Detection data of the driving amount sensor 32 is outputted to the control device 40.

The driving amount sensor 32 functions as a position sensor for detecting a position of the holding member 15 within the XY plane. The driving amount of the actuator 17 and a movement amount of the holding member 15 correspond by one to one.

The X-axis sensor 32X can detect the movement amount of the holding member 15 in the X-axis direction from an original point in the sewing machine coordinate system by detecting the rotation amount of the X-axis motor 17X. The Y-axis sensor 32Y can detect the movement amount of the holding member 15 in the Y-axis direction from an original point in the sewing machine coordinate system by detecting the rotation amount of the Y-axis motor 17Y.

Further, the sewing machine 1 includes an epi-illumination device 33 which illuminates the workpiece S. The epi-illumination device 33 is disposed in the vicinity of the imaging device 30. The epi-illumination device 33 illuminates at least the imaging region FA of the imaging device 30 from above. The epi-illumination device 33 illuminates the workpiece S to be captured by the imaging device 30.

The display device 80 displays at least image data of the workpiece S captured by the imaging device 30. The display device 80 includes a display panel 81 which displays the image data captured by the imaging device 30 and an illumination operation panel 82 capable of receiving an operation related to the epi-illumination device 33.

The display panel 81 is a display device including a flat panel display such as a liquid crystal display or an organic EL display.

The illumination operation panel 82 has a function as an input device which generates input data by being operated by an operator. In the embodiment, the input device is a touch panel disposed to overlap a display screen of the display panel 81.

Figure 3:
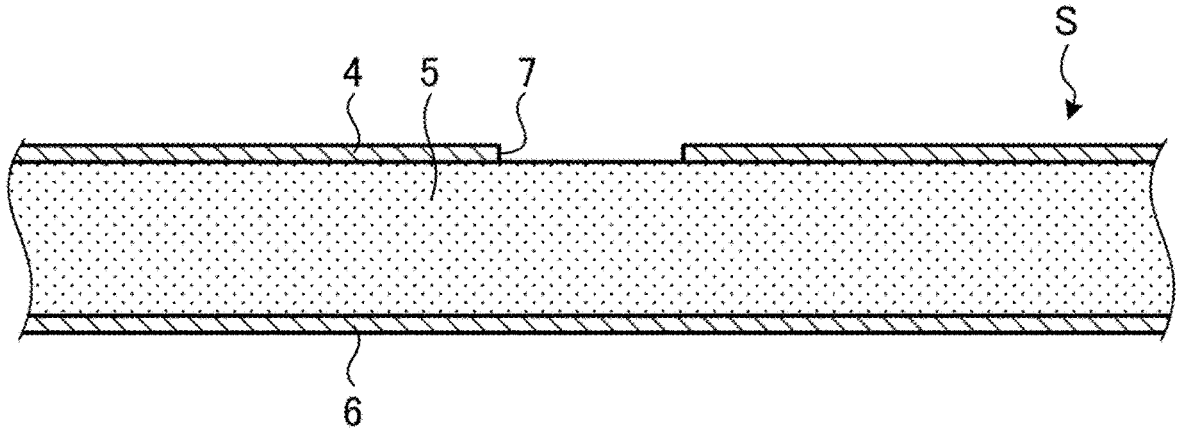
FIG. 3 is a cross-sectional view illustrating an example of a workpiece according to the first embodiment.
Figure 4:
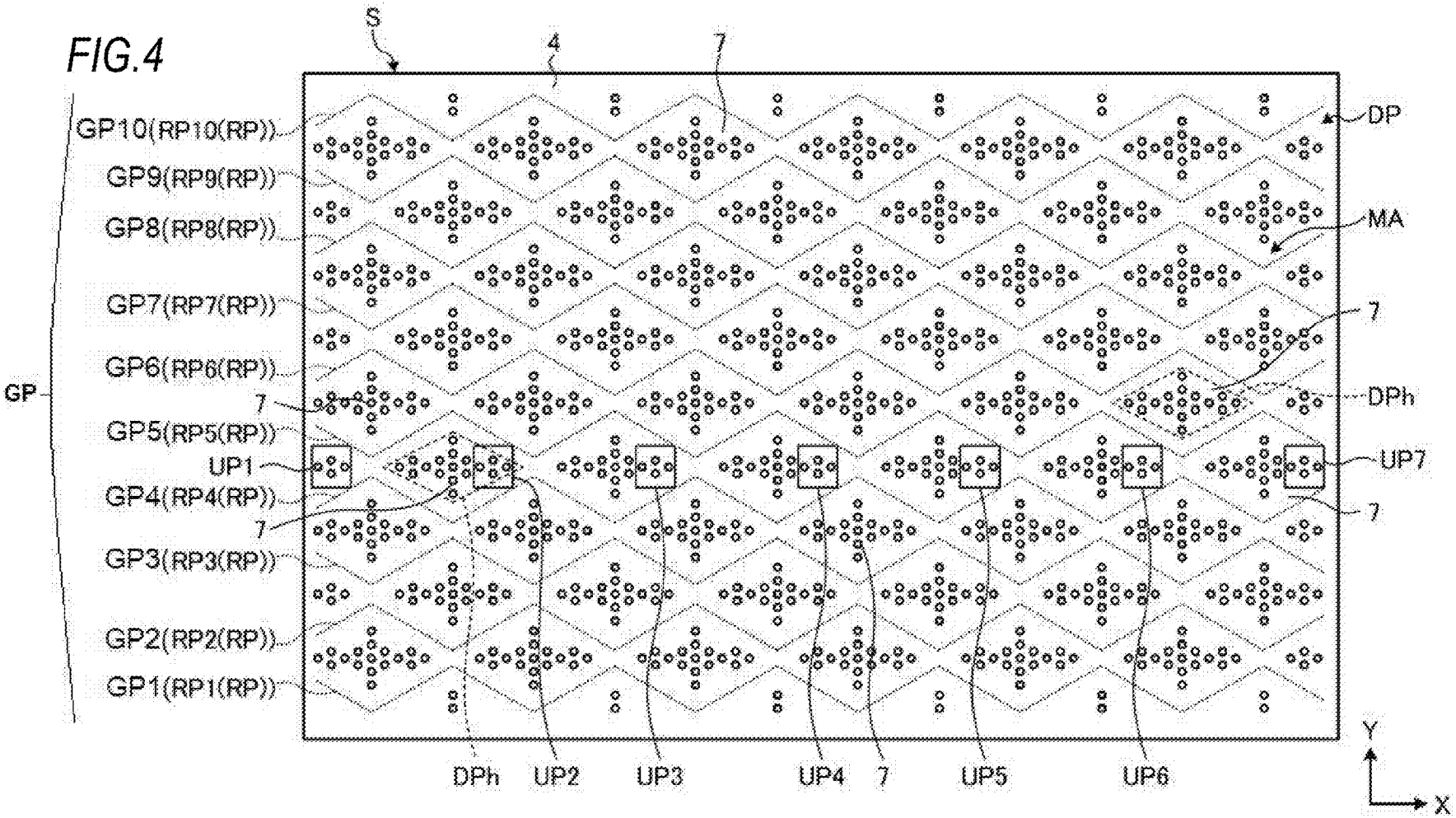
FIG. 4 is a plan view illustrating an example of the workpiece according to the first embodiment.

The workpiece S will be described with reference to FIGS. 3 and 4. FIG. 3 is a cross-sectional view illustrating an example of the workpiece S according to the embodiment. FIG. 4 is a plan view illustrating an example of the workpiece S according to the embodiment. FIGS. 3 and 4 illustrate the workpiece S before sewing processing is performed. In the embodiment, the workpiece S is a skin material used for a vehicle seat.

As illustrated in FIG. 3, the workpiece S has a surface material 4, a pad material 5, and a backing material 6. A hole 7 is formed in the surface material 4.

The surface of the surface material 4 is a seating surface that comes into contact with a passenger when the passenger sits on the vehicle seat. The surface material 4 includes at least one of woven fabric, nonwoven fabric, and leather. The pad material 5 has elasticity.

The pad material 5 includes, for example, a urethane resin. The backing material 6 includes at least one of woven fabric, nonwoven fabric, and leather.

As illustrated in FIG. 4, a plurality of holes 7 are disposed on the surface material 4. The holes 7 are disposed in a defined pattern DP. In the embodiment, the defined pattern DP includes a plurality of reference patterns DPh. One reference pattern DPh is formed by the plurality of holes 7. In the embodiment, the reference pattern DPh is formed by the plurality of holes 7. In the embodiment, one reference pattern DPh is formed by 17 pieces of the holes 7.

As illustrated in FIG. 4, the reference patterns DPh are disposed on the surface material 4 at intervals. The reference patterns DPh are disposed at equal intervals in each of the X-axis direction and the Y-axis direction. The reference patterns DPh having different positions in the Y-axis direction are disposed between the reference patterns DPh adjacent to each other in the X-axis direction. The holes 7 are not formed between the adjacent reference patterns DPh. In the following description, a region in which the holes 7 are not formed between the reference patterns DPh on the surface of the surface material 4 is appropriately referred to as a stitch forming region MA. In the stitch forming region MA, a target pattern RP of the stitch GP formed on the workpiece S is formed.

Further, a plurality of feature patterns UP (UP1, UP2, UP3, UP4, UP5, UP6, and UP7) are disposed on the workpiece S. In the embodiment, the feature pattern UP is a part of the defined pattern DP. In the embodiment, the feature pattern UP is a part of the reference pattern DPh. As illustrated in FIG. 4, in the embodiment, the feature pattern UP (UP1, UP2, UP3, UP4, UP5, UP6, and UP7) is a pattern including one acute corner part of the reference pattern DPh. The feature pattern UP is a pattern that can be identified by a pattern matching method which is a kind of image processing method.

Figure 5:
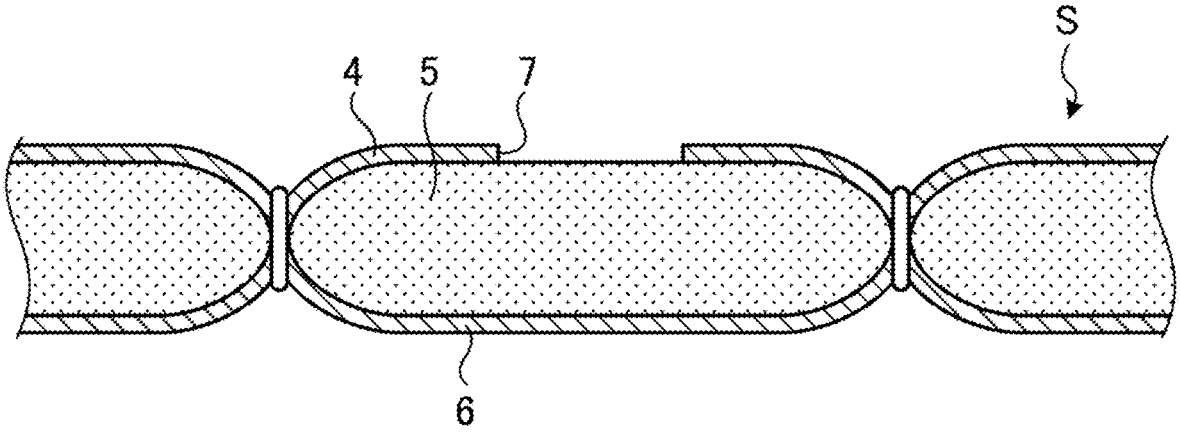
FIG. 5 is a cross-sectional view illustrating an example of the workpiece according to the first embodiment.

The displacement generated on the surface of the workpiece S when the stitch GP is formed on the workpiece S having the thickness and elasticity will be described with reference to FIG. 5. FIG. 5 is a cross-sectional view illustrating an example of the workpiece S according to the embodiment. FIG. 5 illustrates the workpiece S after the sewing processing is performed. The workpiece S has the thickness and elasticity. As the stitch GP is formed on the workpiece S having the thickness and elasticity, there is a high possibility that the workpiece S shrinks as illustrated in FIG. 5. When the workpiece S shrinks, there is a possibility that the surface of workpiece S is displaced. When the surface of the workpiece S is displaced, there is a high possibility that a target position of the stitch GP defined on the surface of the workpiece S is displaced within the XY plane. In a case where the target position of the stitch GP is displaced within the XY plane, when the holding member 15 is moved according to the target pattern RP, it becomes difficult to form the stitch GP at the target position. Therefore, even when the workpiece S shrinks due to the formation of the stitch GP and the surface of the workpiece S is displaced, the holding member 15 moves according to a displacement amount so that the next stitch GP is formed at the target position.

In the following description, the target position of the stitch GP defined on the surface of the workpiece S is appropriately referred to as a stitch forming target position. The stitch forming target position is defined in the sewing machine coordinate system.

Figure 6:
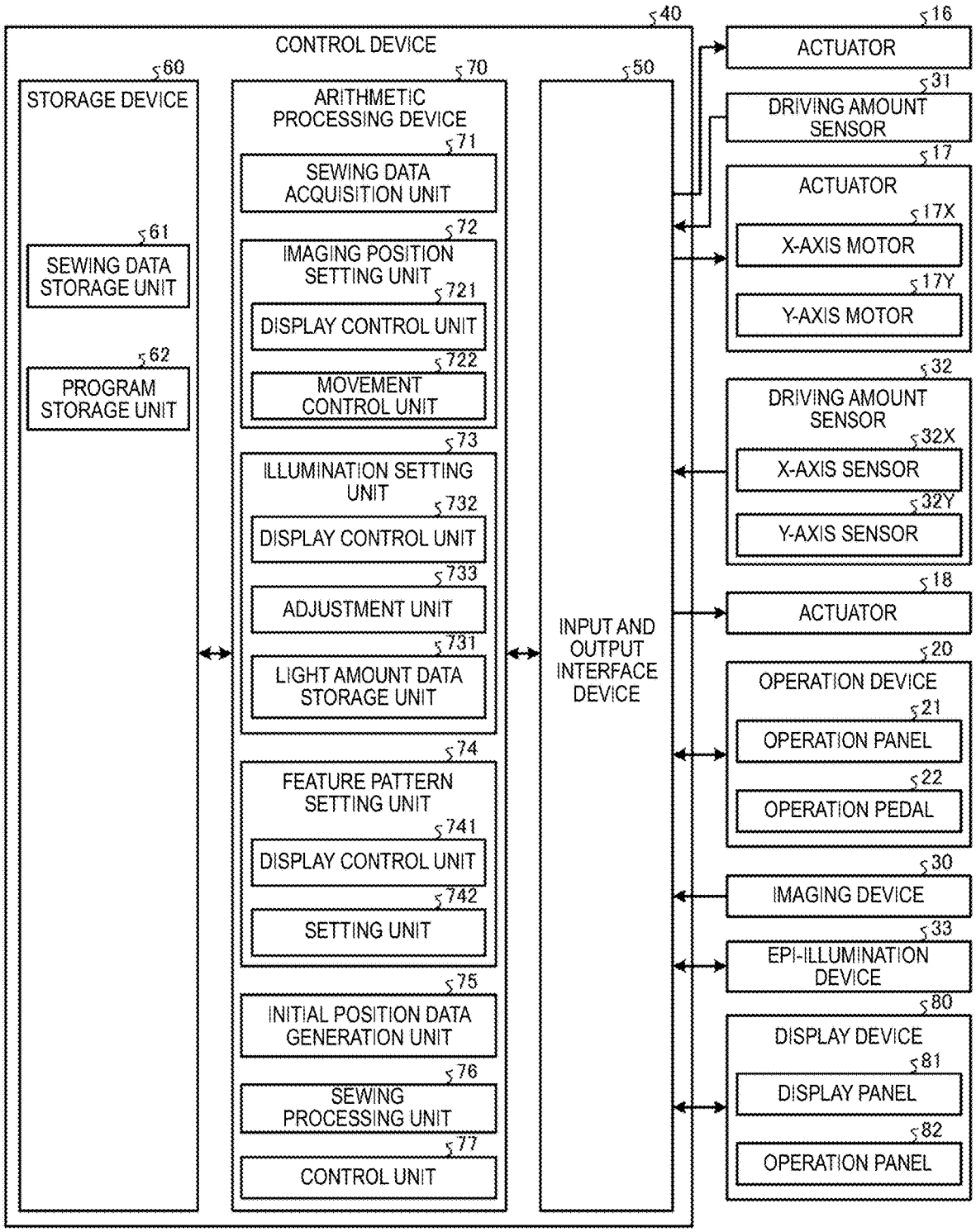
FIG. 6 is a functional block diagram illustrating an example of a control device according to the first embodiment.

The control device 40 will be described with reference to FIG. 6. FIG. 6 is a functional block diagram illustrating an example of the control device 40 according to the embodiment. The control device 40 outputs a control signal for controlling the sewing machine 1. The control device 40 includes a computer system. The control device 40 includes: an input and output interface device 50; a storage device 60 including a nonvolatile memory such as read only memory (ROM) or storage, and a volatile memory such as random access memory (RAM); an arithmetic processing device 70 including a processor such as a central processing unit (CPU).

The actuator 16 which moves the needle 3 in the Z-axis direction, the actuator 17 which moves the holding member 15 within the XY plane, the actuator 18 which moves the pressing member 15A of the holding member 15 in the Z-axis direction, the operation device 20, the imaging device 30, the epi-illumination device 33, and the display device 80 are connected to the control device 40 via the input and output interface device 50.

Further, the driving amount sensor 31 for detecting the driving amount of the actuator 16 and the driving amount sensor 32 for detecting the driving amount of the actuator 17 are connected to the control device 40.

The control device 40 controls the actuator 16 based upon the detection data of the driving amount sensor 31. The control device 40 determines, for example, an operation timing of the actuator 16 based upon the detection data of the driving amount sensor 31.

The control device 40 controls the actuator 17 based upon the detection data of the driving amount sensor 32. Based upon the detection data of the driving amount sensor 32, the control device 40 performs feedback control of the actuator 17 so that the holding member 15 moves to the target position.

The control device 40 calculates the position of the holding member 15 within the XY plane based upon the detection data of the driving amount sensor 32. Based upon the detection data of the driving amount sensor 32, the movement amount of the holding member 15 from the original point within the XY plane is detected. The control device 40 calculates the position of the holding member 15 within the XY plane based upon the detected movement amount of the holding member 15.

The storage device 60 includes a sewing data storage unit 61 and a program storage unit 62.

The sewing data storage unit 61 stores the sewing data. The sewing data is known data that can be derived from the design data of the workpiece S such as computer aided design (CAD) data.

The sewing data will be described with reference to FIG. 4. The sewing data is referred to in the sewing processing. The sewing data includes the target pattern RP of the stitch GP formed on the workpiece S and a movement condition of the holding member 15.

The target pattern RP includes the target shape or the target pattern of the stitch GP formed on the workpiece S. The target pattern RP is defined in the sewing machine coordinate system.

The movement condition of the holding member 15 includes a movement track of the holding member 15 defined in the sewing machine coordinate system. The movement track of the holding member 15 includes the movement track of the holding member 15 within the XY plane. The movement condition of the holding member 15 is determined based upon the target pattern RP.

The sewing data includes the stitch forming target position defined on the surface of the workpiece S. The stitch forming target position is defined in the stitch forming region MA. The sewing machine 1 performs the sewing processing based upon the sewing data so that the stitch GP is formed at the stitch forming target position.

The sewing data includes a plurality of pieces of sewing data for forming each of the plurality of stitches GP (GP1, GP2, GP3, GP4, GP5, GP6, GP7, GP8, GP9, and GP10). In the embodiment, the sewing data includes first sewing data for forming a first stitch GP1, second sewing data for forming a second stitch GP2, and third sewing data to tenth sewing data for forming a third stitch GP3 to a tenth stitch GP10 in the same manner.

The target pattern RP includes a first target pattern RP1, a second target pattern RP2, and in the same manner, a third target pattern RP3 to a tenth target pattern RP10. In the embodiment, a plurality of target patterns RP (RP1, RP2, RP3, RP4, RP5, RP6, RP7, RP8, RP9, and RP10) are defined in the Y-axis direction. In the sewing machine coordinate system, each of the plurality of target patterns RP is separated from each other. One target pattern RP is defined in a line shape. In the embodiment, one target pattern RP extends in the X-axis direction and is defined in a zigzag shape in the Y-axis direction. The stitch forming target position extends in the X-axis direction in the stitch forming region MA and is defined in a zigzag shape in the Y-axis direction corresponding to the target pattern RP.

The first sewing data includes the first target pattern RP1 of the first stitch GP1 formed on the workpiece S in first sewing processing. Further, the first sewing data includes the movement condition of the holding member 15 within the XY plane in the first sewing processing.

The first sewing processing includes processing of forming the first stitch GP1 on the workpiece S based upon the first target pattern RP1. The first sewing processing is processing of firstly forming the stitch GP on the workpiece S after the workpiece S is held by the holding member 15.

The second sewing data includes the second target pattern RP2 of the second stitch GP2 formed on the workpiece S in second sewing processing. Further, the second sewing data includes the movement condition of the holding member 15 within the XY plane in the second sewing processing.

The second sewing processing includes processing of forming the second stitch GP2 on the workpiece S based upon the second target pattern RP2. The second sewing processing is performed after the first sewing processing.

In the same manner, each of the third sewing data to the tenth sewing data includes each of the third target pattern RP3 to the tenth target pattern RP10 of each of the third stitch GP3 to the tenth stitch GP10 formed on the workpiece S in each of the third sewing processing to the tenth sewing processing. Further, each of the third sewing data to the tenth sewing data includes the movement condition of the holding member 15 within the XY plane in each of the third sewing processing to the tenth sewing processing.

In the same manner, each of the third sewing processing to the tenth sewing processing includes processing of forming each of the third stitch GP3 to the tenth stitch GP10 on the workpiece S based upon each of the third target pattern RP3 to the tenth target pattern RP10. The third sewing processing to the tenth sewing processing are performed in order.

The first sewing data is referred to in the first sewing processing. The second sewing data is referred to in the second sewing processing. In the same manner, each of the third sewing data to the tenth sewing data is referred to in each of the third sewing processing to the tenth sewing processing.

The sewing data includes a sewing order for forming the first stitch GP1 to the tenth stitch GP10. As described above, the sewing data is defined so that the second sewing processing for forming the second stitch GP2 is performed after the first sewing processing for forming the first stitch GP1 is performed. In the same manner, the sewing data is defined so that the third sewing processing for forming the third stitch GP3 to the tenth sewing processing for forming the tenth stitch GP10 are performed in order.

Figure 7:
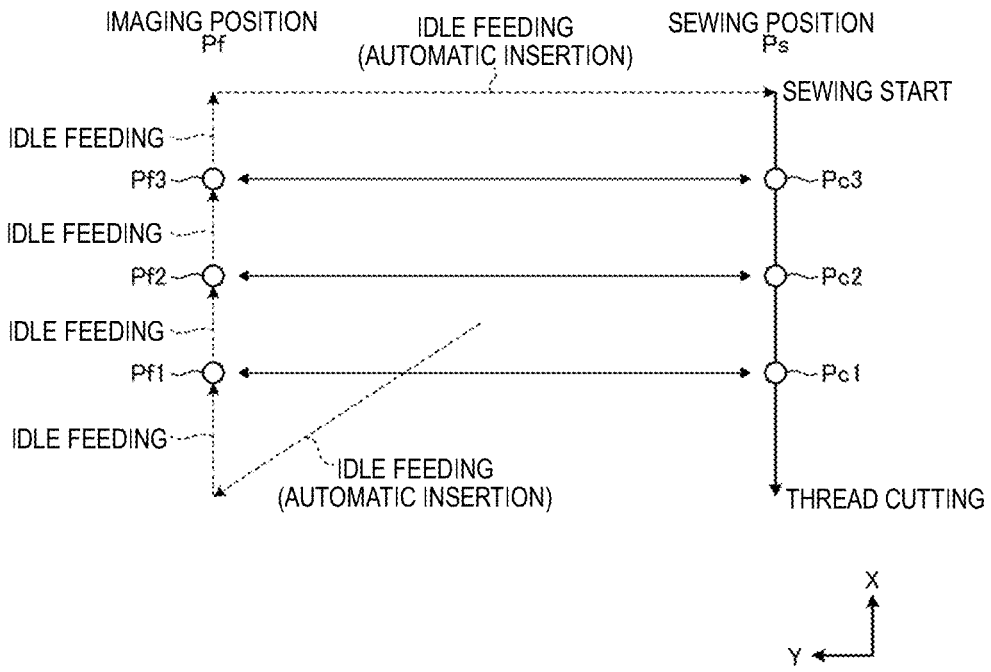
FIG. 7 is a schematic view illustrating a correction point and an imaging position of the workpiece according to the first embodiment.

Further, as illustrated in FIG. 7, with respect to each of the plurality of target patterns RP, the sewing data includes: position data of a correction point Pc (Pc1, Pc2, and Pc3) which is a reference point for correcting the displacement of the surface of the workpiece S; position data of the imaging position Pf (Pf1, Pf2, and Pf3) of the plurality of feature patterns UP of the workpiece S captured by the imaging device 30 in order to calculate the displacement amount of the correction point Pc; and an idle feeding amount of the holding member 15 for moving the correction point Pc to the imaging region FA of the imaging device 30. The position data of the correction point Pc can be acquired from the design data of the workpiece S. The position data of the imaging position Pf can be acquired from the design data of the workpiece S and the position data of the correction point Pc. Further, the position data of the imaging position Pf may be set by operating an operation unit displayed by a feature pattern setting unit 74 which will be described later. The idle feeding amount can be acquired based upon the design data of the workpiece S and a distance between the correction points Pc adjacent to each other in the sewing direction. FIG. 7 is a schematic view illustrating the correction point Pc and the imaging position Pf of the workpiece S according to the embodiment.

Figure 8:
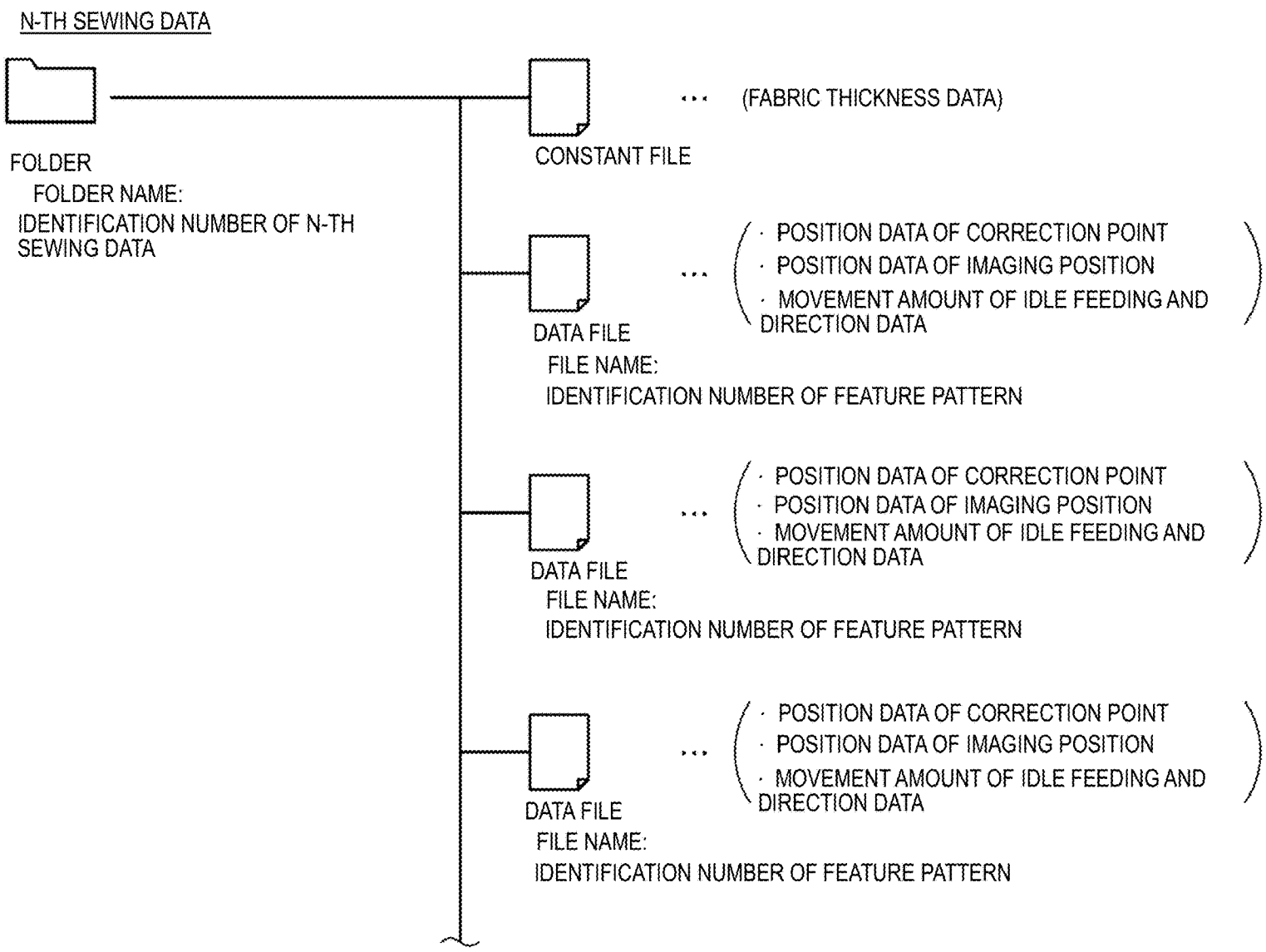
FIG. 8 is a schematic view illustrating an example of a directory configuration of workpiece data according to the first embodiment.

An example of a directory configuration of the sewing data will be described with reference to FIG. 8. FIG. 8 is a schematic view illustrating an example of a directory configuration of workpiece data according to the embodiment. Sewing data is stored in the sewing data storage unit 61 of the storage device 60 with the directory configuration illustrated in FIG. 6. The sewing data includes a definition file and a data file. The definition file includes thickness data of the fabric of the workpiece S. The data file includes: the position data of the correction point Pc corresponding to the feature pattern UP; the position data of the imaging position Pf of the feature pattern UP; and the idle feeding amount of the holding member 15 up to the next imaging position Pf or a start position SP of the sewing processing.

More specifically, in a folder of a folder name including an identification number for identifying n-th sewing data, the definition file storing a setting value, and the like and a plurality of data files of file names including identification numbers for identifying the feature patterns UP included in the n-th sewing data are stored for each n-th sewing data.

Referring back to FIG. 6, the program storage unit 62 stores a computer program for controlling the sewing machine 1. The sewing data stored in the sewing data storage unit 61 is inputted into the computer program stored in the program storage unit 62. The computer program is read into the arithmetic processing device 70. The arithmetic processing device 70 controls the sewing machine 1 according to the computer program stored in the program storage unit 62.

The arithmetic processing device 70 includes a sewing data acquisition unit 71, an imaging position setting unit 72, an illumination setting unit 73, the feature pattern setting unit 74, an initial position data generation unit 75, and a sewing processing unit 76.

The sewing data acquisition unit 71 acquires the sewing data from the sewing data storage unit 61. In the embodiment, the sewing data acquisition unit 71 acquires the first sewing data to be referred to in the first sewing processing and the second sewing data to be referred to in the second sewing processing to be performed after the first sewing processing from the sewing data storage unit 61. In the same manner, the sewing data acquisition unit 71 acquires each of the third sewing data to the tenth sewing data to be referred to in each of the third sewing processing to the tenth sewing processing from the sewing data storage unit 61.

The imaging position setting unit 72 outputs a control signal to the actuator 17 which moves the holding member 15 based upon the sewing data acquired by the sewing data acquisition unit 71, such that the plurality of feature patterns UP disposed on the workpiece S are sequentially disposed in the imaging region FA of the imaging device 30.

Further, when generating the initial position data, the imaging position setting unit 72 can set the imaging position Pf by the operation of an operator. More specifically, when generating the initial position data, the imaging position setting unit 72 performs control to move the imaging position Pf before and after the current imaging position Pf to the imaging region FA of the imaging device 30 based upon the sewing data. The imaging position setting unit 72 includes a display control unit 721 and a movement control unit 722.

When generating the initial position data, the display control unit 721 displays an operation unit 21A capable of receiving an operation for moving the imaging position Pf before and after the current imaging position Pf to the imaging region FA of the imaging device 30 on the operation panel 21 of the operation device 20.

Figure 9:
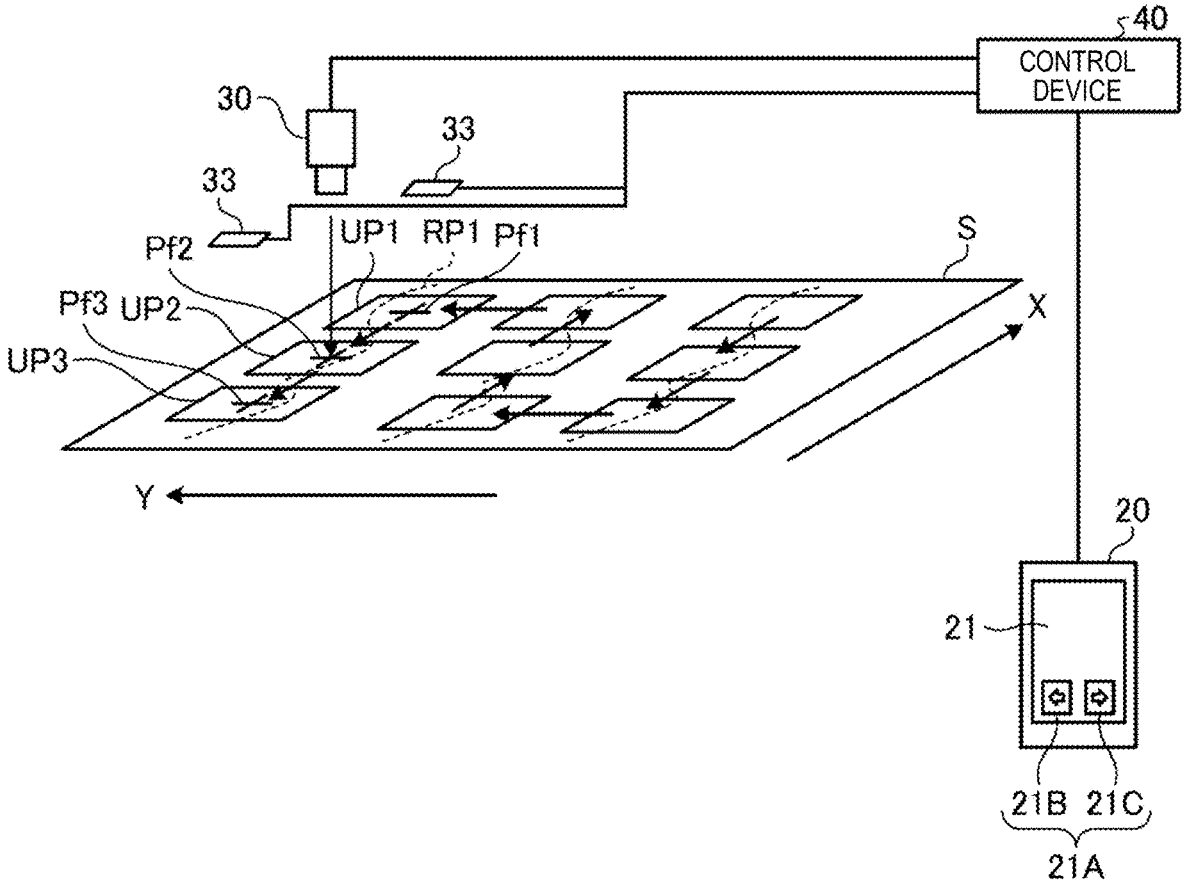
FIG. 9 is a schematic view illustrating an example of the sewing machine according to the first embodiment.

The operation unit 21A displayed on the operation panel 21 by the display control unit 721 will be described with reference to FIG. 9. FIG. 9 is a schematic view illustrating an example of the sewing machine 1 according to the embodiment. The operation unit 21A includes: a front key 21B for moving the imaging position Pf before (next) the current imaging position Pf to the imaging region FA of the imaging device 30; and a rear key 21C for moving the imaging position pf after the current imaging position Pf to the imaging region FA of the imaging device 30. The imaging position Pf therebefore (next) is the imaging position Pf to be captured next when the holding member 15 is moved in order corresponding to the sewing order. The imaging position Pf thereafter is captured next when the holding member 15 is moved in reverse order corresponding to the sewing order, in order words, the imaging position Pf thereafter is the imaging position Pf that is already captured.

The movement control unit 722 outputs a control signal to the actuator 17 based upon the sewing data so that the plurality of feature patterns UP disposed on the workpiece S are sequentially disposed in the imaging region FA of the imaging device 30 in order or in reverse order corresponding to the sewing order.

In the embodiment, the movement control unit 722 outputs the control signal for moving the imaging position Pf before and after the current imaging position Pf to the imaging region FA of the imaging device 30 by moving the holding member 15 in response to the operation with respect to the operation unit 21A, based upon the sewing data. More specifically, when an operation with respect to the front key 21B is detected, the movement control unit 722 drives the X-axis motor 17X of the actuator 17 to cause the holding member 15 to move in the X-axis direction by the idle feeding amount, such that the imaging position Pf before the current imaging position Pf is moved to the imaging region FA of the imaging device 30. When an operation with respect to the rear key 21C is detected, the movement control unit 722 drives the X-axis motor 17X of the actuator 17 to cause the holding member 15 to move in the X-axis direction by the idle feeding amount, such that the imaging position Pf after the current imaging position Pf is moved to the imaging region FA of the imaging device 30. Further, when the current imaging position Pf is an end part in the X-axis direction, the movement control unit 722 drives the Y-axis motor 17Y of the actuator 17, thereby causing the holding member 15 to move in the Y-axis direction by the idle feeding amount.

The illumination setting unit 73 outputs a control signal for controlling a light amount of the epi-illumination device 33 depending on the color of the surface of the workpiece S (color of a material of the surface material 4) based upon an operation with respect to the illumination operation panel 82. Further, the illumination setting unit 73 may automatically control the light amount without depending on the operation of the operator. The illumination setting unit 73 includes a display control unit 732, an adjustment unit 733, and a light amount data storage unit 731.

Figure 10:
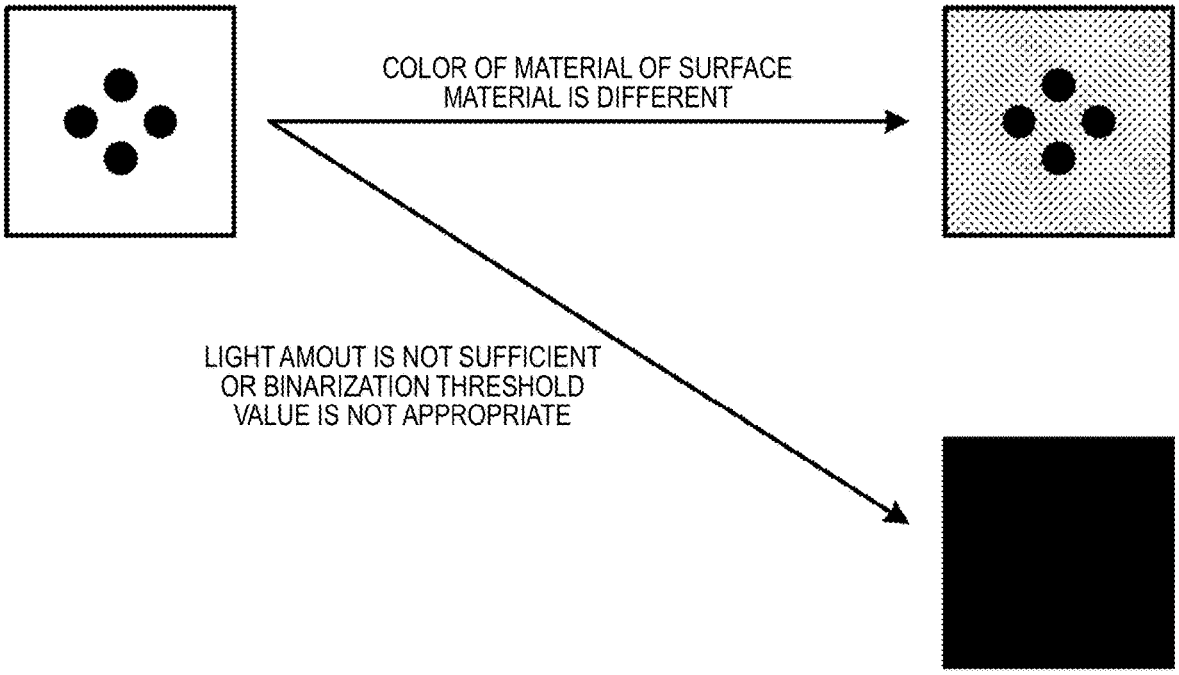
FIG. 10 is a view illustrating the workpiece and a light amount of an illumination device according to the first embodiment.

A relationship between the color of the surface material 4 and the light amount will be described with reference to FIG. 10. FIG. 10 is a view illustrating the workpiece S and the light amount of illumination according to the embodiment. When the color of the surface material 4 and the light amount are appropriate, the contrast between the surface material 4 and the hole 7 becomes large as shown on the left. For example, when the color of the surface material 4 shown on the left is different from that of the material, the light amount does not become appropriate and thus the contrast between the surface material 4 and the hole 7 becomes small as shown on the upper right. Further, for example, when recognition parameter is inconsistent, such as an insufficient light amount or inappropriate binarization threshold value, as shown in the lower right of FIG. 10, the whole captured image becomes darkened or a boundary between the surface material 4 and the hole 7 becomes unclear or indistinct.

The display control unit 732 displays an operation unit 82A capable of receiving an operation for adjusting the light amount of the epi-illumination device 33 on the illumination operation panel 82 of the display device 80.

Figure 11:
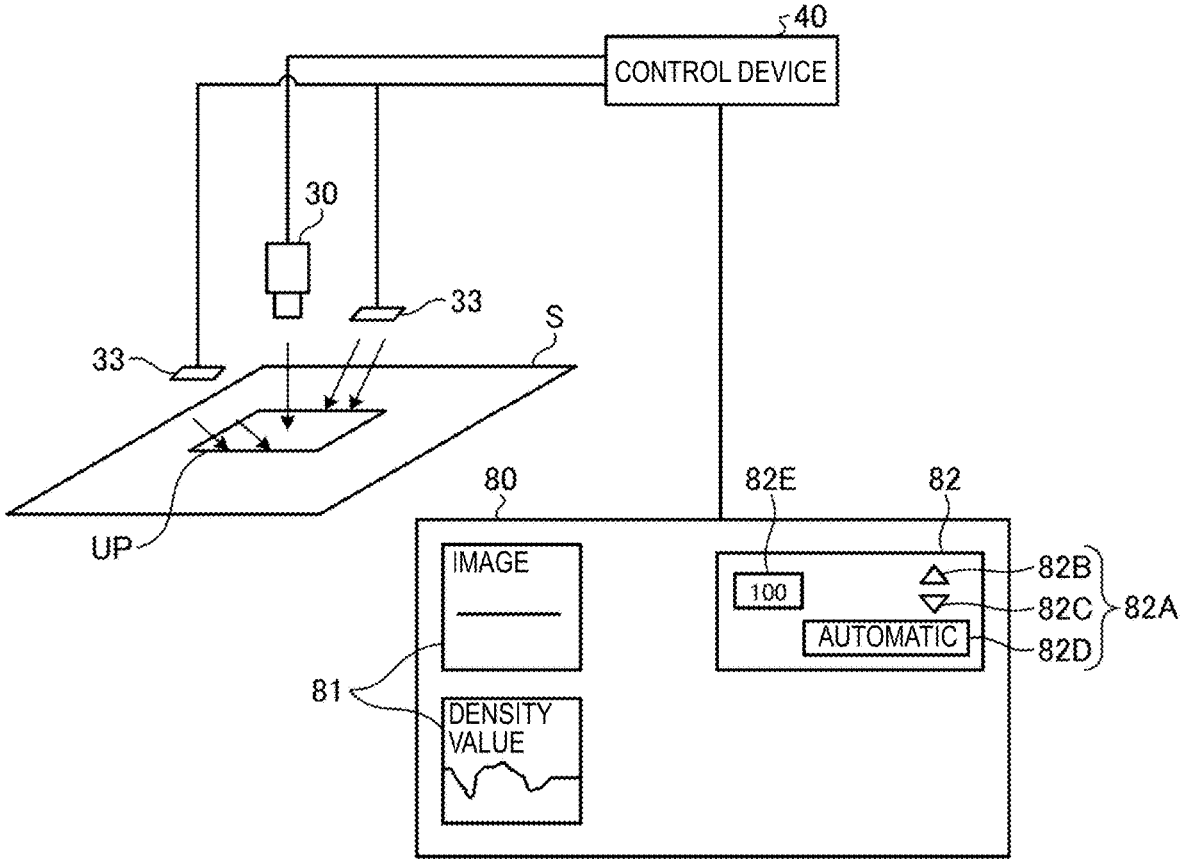
FIG. 11 is a schematic view illustrating an example of the sewing machine according to the first embodiment.

The operation unit 82A displayed on the illumination operation panel 82 by the display control unit 732 will be described with reference to FIG. 11. FIG. 11 is a schematic view illustrating an example of the sewing machine 1 according to the embodiment. The operation unit 82A includes an upper key 82B for increasing the light amount, a lower key 82C for reducing the light amount, and an automatic key 82D for automatically setting the light amount. A light amount display unit 82E is disposed near the operation unit 82A. The light amount display unit 82E displays the light amount.

When an operation with respect to the operation unit 82A is detected, the adjustment unit 733 adjusts the light amount of the epi-illumination device 33. When an operation with respect to the upper key 82B is detected, the adjustment unit 733 increases the light amount of the epi-illumination device 33. When an operation with respect to the lower key 82C is detected, the adjustment unit 733 reduces the light amount of the epi-illumination device 33. When an operation with respect to the automatic key 82D is detected, the adjustment unit 733 automatically adjusts the light amount of the epi-illumination device 33.

The light amount data storage unit 731 stores the light amount adjusted as described above and the binarization threshold value as light amount data in association with the generated initial position data. Further, the light amount data storage unit 731 respectively stores an average density and an allowable range of the surface material 4 and the hole 7 when the appropriate light amount is obtained.

The feature pattern setting unit 74 sets a position of a template frame of the feature pattern UP and the imaging position Pf on the image data captured by the imaging device 30 and displayed on the display panel 81 of the display device 80.

When generating the initial position data, the feature pattern setting unit 74 sets the position of the template frame of the feature pattern UP and the imaging position Pf on the image of the surface of the workpiece S captured by the imaging device 30 by the operation of the display device 80 by the operator. In the embodiment, the imaging position Pf is a center position of the template frame. The feature pattern setting unit 74 includes a display control unit 741 and a setting unit 742.

Figure 12:
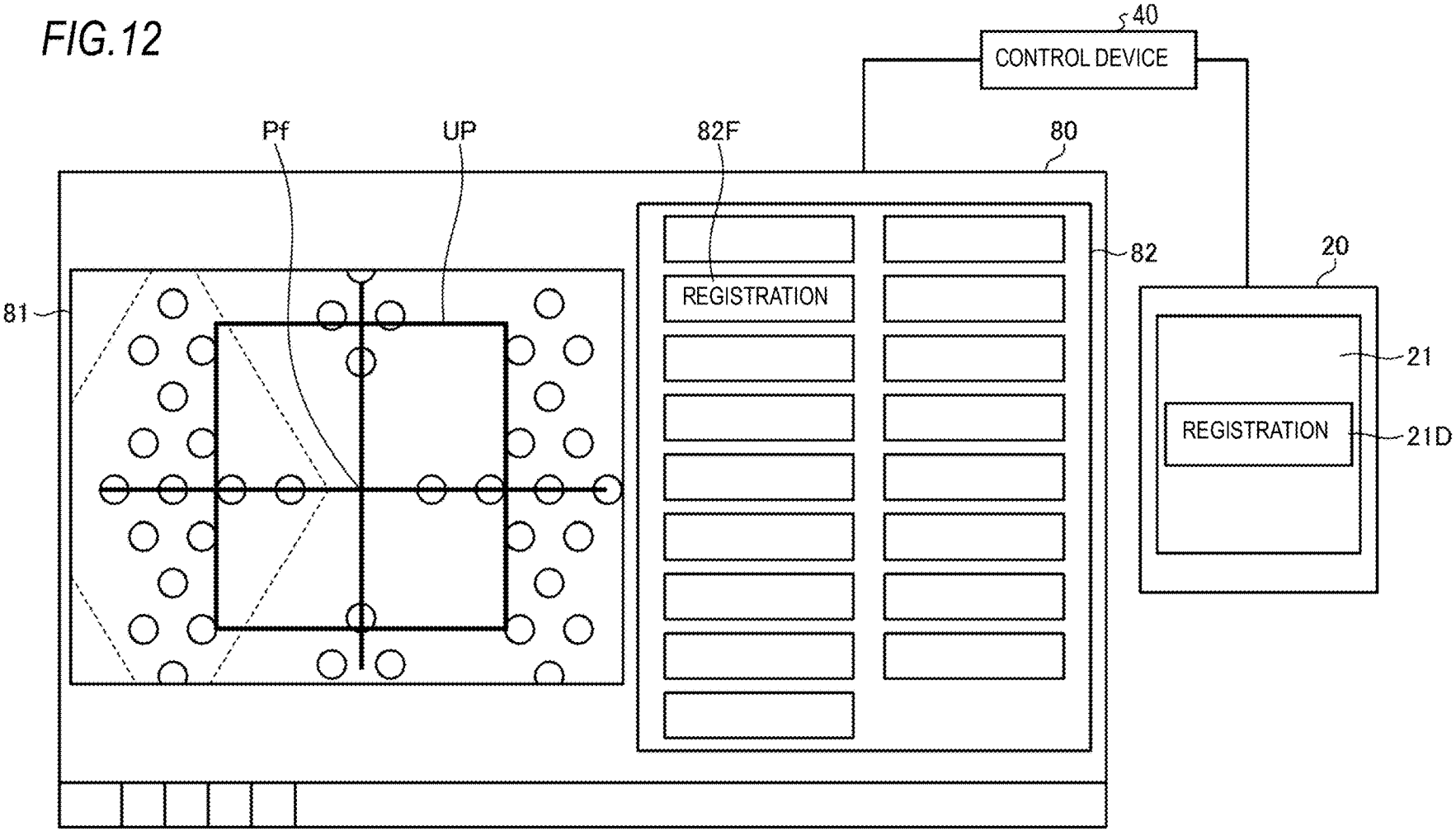
FIG. 12 is a schematic view illustrating an example of the sewing machine according to the first embodiment.

The operation unit 82A displayed on the illumination operation panel 82 by the display control unit 741 will be described with reference to FIG. 12. FIG. 12 is a schematic view illustrating an example of the sewing machine 1 according to the embodiment. The display control unit 741 superimposes an image of a cross key indicating the imaging position Pf and an image of the template frame indicating the feature pattern UP on the image of the surface of the workpiece S captured by the imaging device 30 on the display panel 81, after which the superimposed image is displayed thereon. In the embodiment, the template frame is set to be ½ of the area of the captured image. The display control unit 741 displays a registration button image 82F capable of receiving an operation of registering a region surrounded by the template frame on the display panel 81 as the feature pattern UP. Further, the display control unit 741 displays a registration button image 21D capable of receiving an operation of setting the template frame on the operation panel 21 of the operation device 20. An operator can set the feature pattern by the registration button image 21D of the operation device 20 or the registration button image 82F of the display device 80.

When the registration button image 82F or the registration button image 21D is pressed, the setting unit 742 performs image processing on the captured image with the feature pattern UP which is the region surrounded by the template frame on the display panel 81. As a result of the image processing, when recognition is correctly enabled, the setting unit 742 stores the position of the feature pattern UP which is the region surrounded by the template frame on the display panel 81 and the imaging position Pf which is the center position based upon the driving amount of the actuator 17 detected by the driving amount sensor 32. When the recognition is not correctly enabled, the setting unit 742 enlarges the template frame and then performs the image processing again. When the size of the template frame is increased up to a predetermined upper limit but the recognition is not correctly enabled, the setting unit 742 determines an error.

The initial position data generation unit 75 generates the initial position data indicating the initial positions of the plurality of feature patterns UP disposed on the workpiece S based upon the image data captured by the imaging device 30. The initial position data of the feature pattern UP indicates the initial position of the feature pattern UP in the sewing machine coordinate system. The initial position data generation unit 75 automatically acquires the initial position of the feature pattern UP based upon the image data of the feature pattern UP of the workpiece S before the sewing processing is started. Further, the initial position data of the feature pattern UP may be acquired by the operation with respect to the operation unit 21A displayed on the operation panel 21. The initial position data of the feature pattern UP is known data that can be derived from the design data of the workpiece S such as CAD data. The initial position data of the feature pattern UP is stored in the sewing data storage unit 61.

The initial position data of the feature pattern UP defines the light amount data of the epi-illumination device 33 for each workpiece S.

Further, the generation of the initial position data may be automatically or manually derived from the CAD data, or the initial position data may be generated by operating the operation unit 21A displayed on the operation panel 21 as illustrated in FIG. 9.

A method of generating the initial position data by the operation with respect to the operation unit 21A displayed on the operation panel 21 will be described. First, the control device 40 controls the actuator 17 to move the feature pattern UP on the workpiece S held by the holding member 15 to the imaging region FA of the imaging device 30. In the embodiment, a center position C of the feature pattern UP is moved to an optical axis position which is a center position of the imaging region FA of the imaging device 30. The imaging device 30 captures the feature pattern UP disposed in the imaging region FA. The initial position data generation unit 75 acquires the image data of the feature pattern UP. The initial position data generation unit 75 identifies the feature pattern UP by performing the image processing on the image data of the feature pattern UP by the pattern matching method. The position of the holding member 15 in the sewing machine coordinate system of when the feature pattern UP is disposed in the imaging region FA of the imaging device 30 is detected by the driving amount sensor 32. As described above, the driving amount sensor 32 functions as a position sensor for detecting the position of the holding member 15 within the XY plane. The initial position data generation unit 75 acquires the detection data of the driving amount sensor 32. Thus, based upon the detection data of the driving amount sensor 32 of when the feature pattern UP is disposed in the imaging region FA, the initial position data generation unit 75 acquires the initial position data indicating the initial position within the XY plane of the feature pattern UP disposed in the imaging region FA. When the next feature pattern UP is moved to the imaging region FA of the imaging device 30, the next feature pattern UP may be moved automatically or moved by the operation with respect to the operation unit 21A. The processing described above is repeated, thereby generating the initial position data.

The sewing processing unit 76 forms a predetermined stitch on the workpiece S based upon the sewing data, the initial position data, and the correction data generated based upon the displacement amount of the correction point Pc all of which are generated as described above. Further, when sewing the workpiece S, the sewing processing unit 76 may automatically adjust the light amount based upon the light amount data set at the time of generation of the initial position data.

Figure 13:
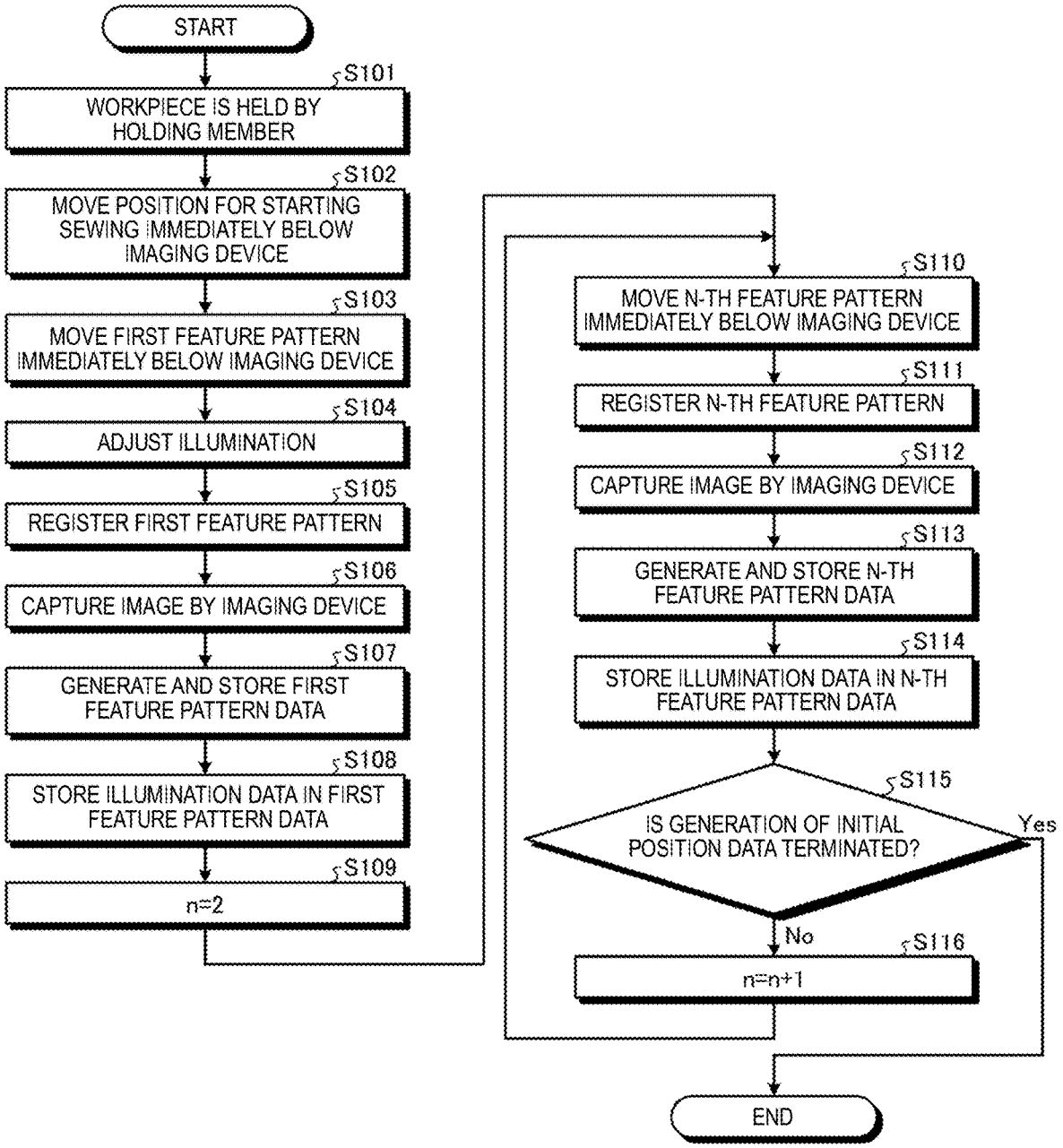
FIG. 13 is a flowchart illustrating an example of an initial position data generation method according to the first embodiment.

Next, an initial position data generation method according to the embodiment will be described with reference to FIG. 13. FIG. 13 is a flowchart illustrating an example of an initial position data generation method according to the first embodiment.

The workpiece S is held by the holding member 15 (step S101).

The control device 40 controls the actuator 17, thereby moving a start position SP1 of the sewing processing which is a position for starting the sewing to the imaging region FA immediately below the imaging device 30 (step S102).

The control device 40 controls the actuator 17 based upon the idle feeding amount of the first sewing data, thereby moving the first feature pattern UP1 to the imaging region FA immediately below the imaging device 30 (step S103). The control device 40 moves the holding member 15 so that a center position C1 of the first feature pattern UP1 is disposed at the imaging position Pf of the imaging region FA of the imaging device 30.

The first feature pattern UP1 is a feature pattern according to the first sewing processing. The feature pattern UP according to the first sewing processing is the feature pattern UP closest to the stitch forming target position where the first stitch GP1 is formed by the first sewing processing in the sewing machine coordinate system. In other words, the feature pattern UP according to the first sewing processing is the feature pattern UP closest to the first target pattern RP1 in the sewing machine coordinate system.

The first feature pattern UP1 is disposed in the vicinity of the vertex of the first target pattern RP1 defined in the zigzag shape. In the embodiment, the first feature pattern UP1 is disposed in the vicinity of the end part on the −X side of the workpiece S.

The control device 40 adjusts the epi-illumination device 33 by the illumination setting unit 73 (step S104). An illumination adjustment method of the epi-illumination device 33 will be described later.

The control device 40 registers the first feature pattern UP1 by the feature pattern setting unit 74 (step S105). In the embodiment, the control device 40 causes the display control unit 741 to superimpose the image of the cross key indicating the imaging position Pf and the image of the template frame indicating the first feature pattern UP on the image of the surface of the workpiece S captured by the imaging device 30 on the display panel 81, after which the superimposed image is displayed thereon. The display control unit 741 causes the display panel 81 to display the registration button image 82F, and causes the operation panel 21 to display the registration button image 21D. An operator sets the first feature pattern UP1 by using the registration button image 21D of the operation device 20 or the registration button image 82F of the display device 80.

After the first feature pattern UP1 is set, the control device 40 captures an image by the imaging device 30 (step S106).

The control device 40 acquires the image data of the captured first feature pattern UP1.

The control device 40 generates the data of the first feature pattern UP1 by the initial position data generation unit 75 and then stores the data thereof as initial position data (step S107). The control device 40 stores the position of the first feature pattern UP1 and the imaging position Pf of when the registration button image 82F or the registration button image 21D is pressed as the initial position data in association with the captured image data.

The control device 40 stores illumination data of when the first feature pattern UP1 is captured in the initial position data of the first feature pattern UP1 by the light amount data storage unit 731 (step S108). The illumination data includes a light amount, a binarization threshold value, an average density and an allowable range of the surface material 4 which is a background part, and an average density and an allowable range of the hole 7.

The control device 40 sets a counter n to "2" (step S109).

The control device 40 controls the actuator 17 based upon the idle feeding amount of the (n−1)th sewing data, thereby moving the n-th feature pattern UPn immediately below the imaging device 30 (step S110).

The control device 40 registers the n-th feature pattern UPn by the feature pattern setting unit 74 (step S111).

After the n-th feature pattern UPn is set, the control device 40 captures an image by the imaging device 30 (step S112).

The control device 40 generates data of the n-th feature pattern UPn by the initial position data generation unit 75 and then stores the data thereof as initial position data (step S113).

The control device 40 stores illumination data of when the n-th feature pattern UPn is captured in the initial position data of the n-th feature pattern UPn by the light amount data storage unit 731 (step S114).

The control device 40 determines whether or not the generation of the initial position data is terminated for the first sewing data (step S115). When the generation of the initial position data is terminated for all the feature patterns UP of the first sewing data (Yes in step S115), the control device 40 terminates the processing. When the generation of the initial position data is not terminated for all the feature patterns UP of the first sewing data (No in step S115), the control device 40 proceeds to step S116.

When the generation of the initial position data for all the feature patterns UP of the first sewing data is not terminated (No in step S115), the control device 40 sets the counter n to "+1" (step S116).

Figure 14:
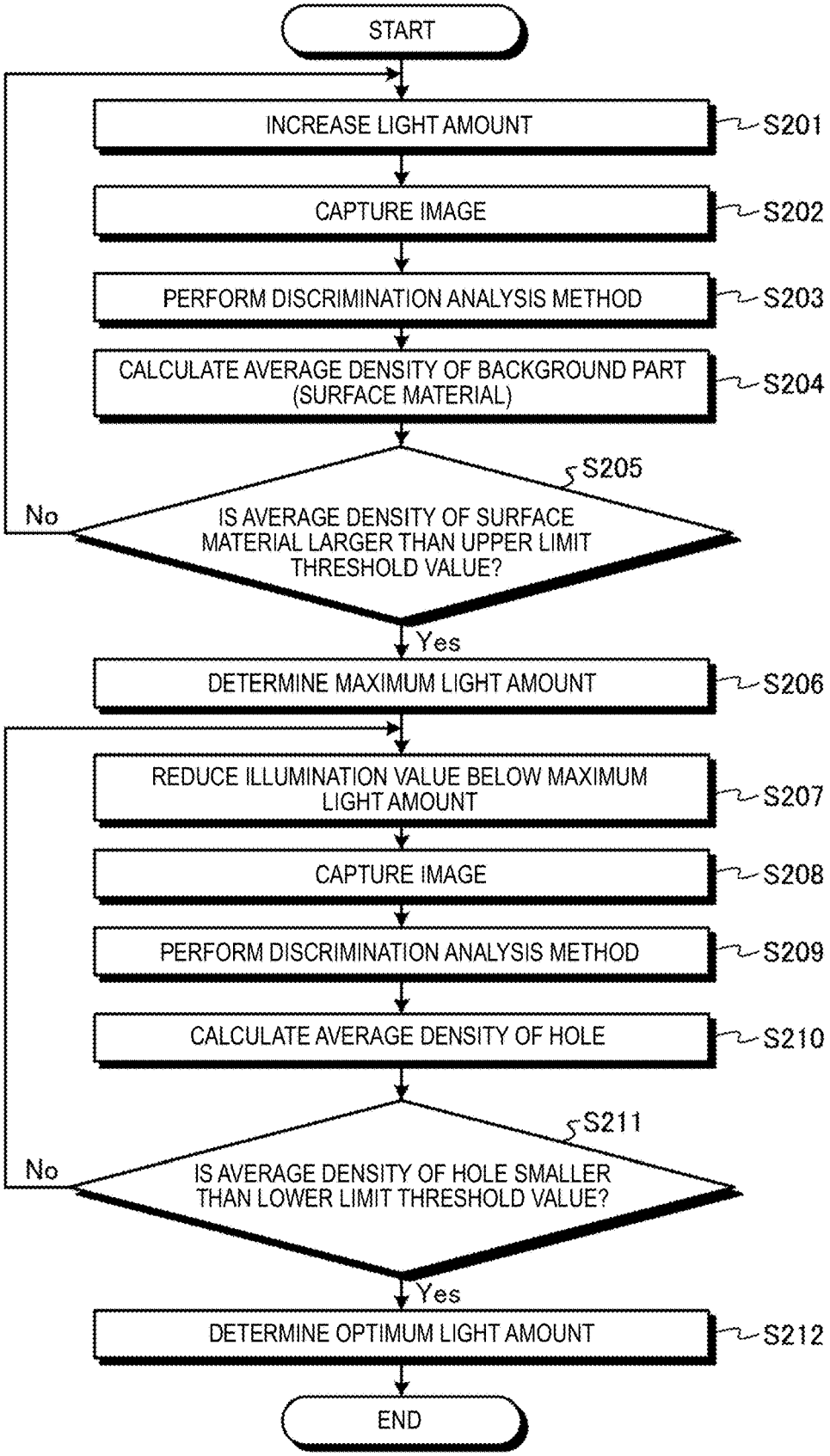
FIG. 14 is a flowchart illustrating an example of an illumination adjustment method according to the first embodiment.
Figure 15:
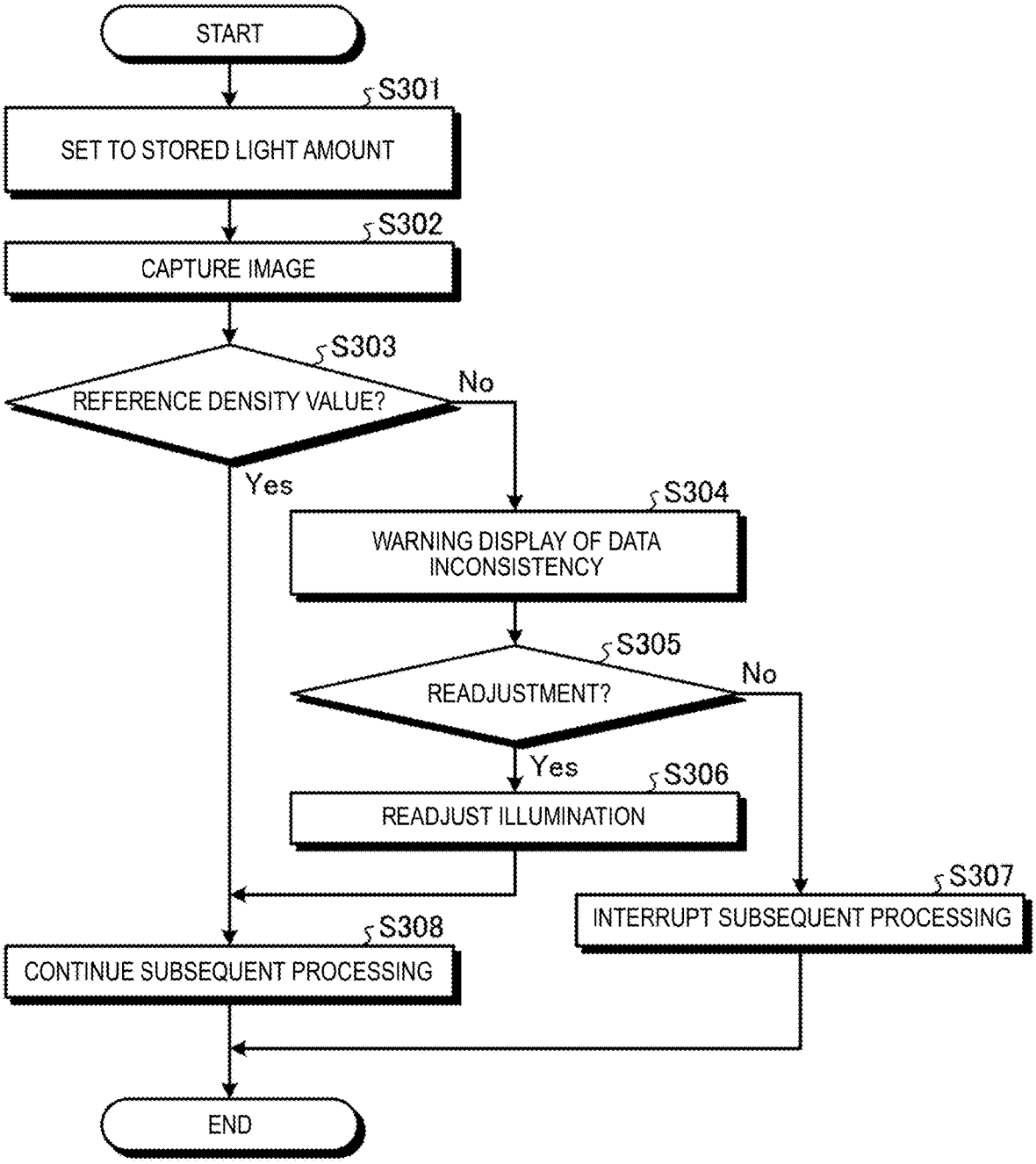
FIG. 15 is a flowchart illustrating another example of the illumination adjustment method according to the first embodiment.

Next, the illumination adjustment method according to the embodiment will be described with reference to FIGS. 14 and 15. FIG. 14 is a flowchart illustrating an example of the illumination adjustment method according to the embodiment. FIG. 15 is a flowchart illustrating another example of the illumination adjustment method according to the embodiment. It is assumed that the workpiece S is held by the holding member 15, and the first feature pattern UP1 is disposed in the imaging region FA of the imaging device 30.

First, a case where the light amount of the epi-illumination device 33 is not stored in the initial position data will be described with reference to FIG. 14. The illumination setting unit 73 increases the light amount of the epi-illumination device 33 (step S201). The illumination setting unit 73 gradually increases the light amount from a preset minimum value.

The illumination setting unit 73 causes the imaging device 30 to capture the image of the workpiece S held by the holding member 15 (step S202).

The illumination setting unit 73 performs a discrimination analysis method (step S203). In the discrimination analysis method, the image processing is performed on the image data obtained by capturing the surface of the workpiece S, and the surface material 4 which is the background part of the workpiece S is discriminated. In the embodiment, when binarization processing is performed, the surface material 4 can be determined as a white region (a high luminance region).

The illumination setting unit 73 calculates the average density of the region determined as the surface material 4 of the workpiece S by the discrimination analysis method (step S204).

The illumination setting unit 73 determines whether or not the average density of the surface material 4 is larger than an upper limit threshold value (step S205). When the average density of the surface material 4 is larger than the upper limit threshold value (Yes in step S205), the illumination setting unit 73 proceeds to step S206. When the average density of the surface material 4 is not larger than the upper limit threshold value (No in step S205), the illumination setting unit 73 returns to step S201 and performs the processing again.

When the average density of the surface material 4 exceeds the upper limit threshold value, the illumination setting unit 73 determines the current light amount as the maximum light amount (step S206).

The illumination setting unit 73 reduces the light amount below the maximum light amount (step S207). The illumination setting unit 73 gradually reduces the light amount from the maximum light amount.

The illumination setting unit 73 causes the imaging device 30 to capture the image of the workpiece S held by the holding member 15 (step S208).

The illumination setting unit 73 performs the discrimination analysis method (step S209). In the discrimination analysis method, the image processing is performed on the image data obtained by capturing the surface of the workpiece S, after which the hole 7 of the workpiece S is determined. In the embodiment, when the binarization processing is performed thereon, the hole 7 can be determined as a black region (a low luminance region).

The illumination setting unit 73 calculates the average density of the region determined as the hole 7 by the discrimination analysis method (step S210).

The illumination setting unit 73 determines whether or not the average density of the holes 7 is smaller than a lower limit threshold value (step S211). When the average density of the holes 7 is smaller than the lower limit threshold value (Yes in step S211), the illumination setting unit 73 proceeds to step S212. When the average density of the holes 7 is not smaller than the lower limit threshold value (No in step S211), the illumination setting unit 73 returns to step S207 and performs the processing again.

The illumination setting unit 73 determines an optimum light amount (step S212). The illumination setting unit 73 determines the current light amount or more and the maximum light amount or less as the optimum light amount.

Next, a case where light amount data (a recognition parameter) including the light amount of the epi-illumination device 33 is stored in the initial position data will be described with reference to FIG. 15. The illumination setting unit 73 sets the light amount of the epi-illumination device 33 to the light amount stored in the initial position data (step S301).

The illumination setting unit 73 captures an image by the imaging device 30 (step S302).

The illumination setting unit 73 determines whether or not the average density of the surface material 4 and the average density of the holes 7 are within a range of a reference density value stored in advance (step S303). The illumination setting unit 73 calculates the average density of the surface material 4 and the average density of the holes 7. When the average density of the surface material 4 and the average density of the holes 7 are within the range of the reference density value (Yes in step S303), the illumination setting unit 73 proceeds to step S308. When the average density of the surface material 4 and the average density of the holes 7 are not within the range of the reference density value (No in step S303), since the current recognition parameter is data inconsistency, the illumination setting unit 73 proceeds to step S304. The recognition parameter includes the light amount data and the binarization threshold value data.

The illumination setting unit 73 displays a warning indicating that the recognition parameter is the data inconsistency (step S304). Further, in addition to the warning display, the illumination setting unit 73 displays a screen for selecting whether or not to readjust the light amount on the display panel 81.

The illumination setting unit 73 determines whether or not a selection operation of readjusting the light amount is performed (step S305). When it is selected that the light amount is readjusted (Yes in step S305), the illumination setting unit 73 proceeds to step S306. When it is selected that the light amount is not readjusted (No in step S305), the illumination setting unit 73 proceeds to step S307.

The illumination setting unit 73 resets the illumination (step S306). As illustrated in FIG. 11, the operation unit 82A is displayed on the illumination operation panel 82 by the display control unit 732. An operator operates the operation unit 82A so that the light amount of the illumination device becomes appropriate. Alternatively, when the light amount is adjusted but the data inconsistency still occurs, the binarization threshold value may be changed.

The illumination setting unit 73 interrupts the subsequent processing (step S307). In this case, the subsequent processing is not performed.

After setting the light amount, the illumination setting unit 73 performs the subsequent processing (step S308). In this case, the subsequent processing is performed with the set light amount.

As described above, in the embodiment, based upon the sewing data including the sewing order, the actuator 17 that moves the holding member 15 is controlled so that the plurality of feature patterns UP of the workpiece S are sequentially disposed in the imaging region FA immediately below the imaging device 30. Since the feature pattern UP on the workpiece S is accurately moved to the imaging region FA immediately below the imaging device 30 corresponding to the sewing order, the initial position data can be easily generated.

Further, in the embodiment, the sewing data includes: the correction point Pc on a line which is the reference point at the time of correction; the imaging position Pf in the feature pattern UP; and the idle feeding amount of the holding member 15 up to the next imaging position Pf or the start position SP of the sewing processing. In the embodiment, based upon such the sewing data, the feature pattern UP on the workpiece S is accurately moved to the imaging region FA immediately below the imaging device 30 corresponding to the sewing order automatically or by operating the operation unit 21A displayed on the operation panel 21. Accordingly, in the embodiment, it is possible to easily generate the initial position data.

On the other hand, when the feature pattern UP of the workpiece S is manually moved to the imaging region FA immediately below the imaging device 30, it is difficult to accurately align the position of the holding member 15 and to accurately align the posture of the workpiece S. Accordingly, effort and time are required to generate the initial position data. In addition, in the case of performing the manual operation, it may be difficult to reproduce repetitive movement to the same position.

In the embodiment, the position of the holding member 15 can be accurately aligned and the posture of the workpiece S can be easily and accurately aligned based upon the sewing data.

Further, in the embodiment, at the time of generating the initial position data, the position of the template frame of the feature pattern UP and the imaging position Pf can be set on the image of the surface of the workpiece S captured by the imaging device 30 by the operation of the operator. According to the embodiment, since the feature pattern UP having higher detection accuracy can be set, more appropriate initial position data can be generated.

Further, in the embodiment, the light amount of the illumination device can be automatically set with respect to the workpiece S set in the holding member 15. Further, in the embodiment, the adjusted light amount and the binarization threshold value are stored as the light amount data in association with the generated initial position data. Accordingly, according to the embodiment, an appropriate light amount can be easily reproduced during the sewing processing.

On the other hand, when the illumination is set manually for each workpiece S, work efficiency and accuracy may vary depending on a skill level of the operator. When the illumination setting is performed manually, it may be difficult to reproduce the same illumination setting.

Further, in the embodiment, when setting the illumination for generating the initial position data with respect to the sewing data for the first time, since the consistency of the recognition parameter of the stored illumination data is checked and the warning is displayed, it is possible to reduce the risk of failure occurrence in the sewing processing. Further, the embodiment can perform readjustment when the inconsistency of the recognition parameter occurs. According to the embodiment, the recognition parameter can be appropriately set in accordance with the material of the surface material 4 of the workpiece S.

Second Embodiment

Figure 16:
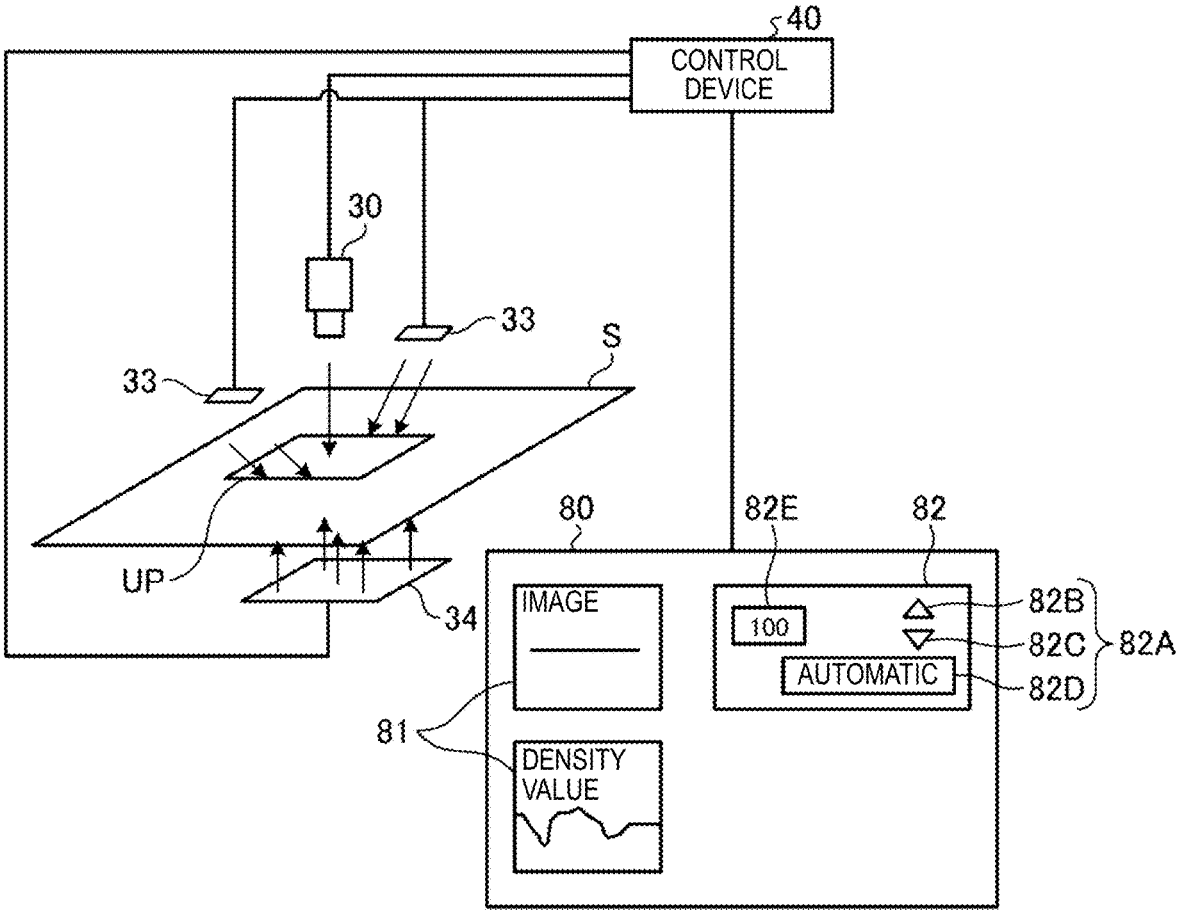
FIG. 16 is a schematic view illustrating an example of a sewing machine according to a second embodiment.
Figure 17:
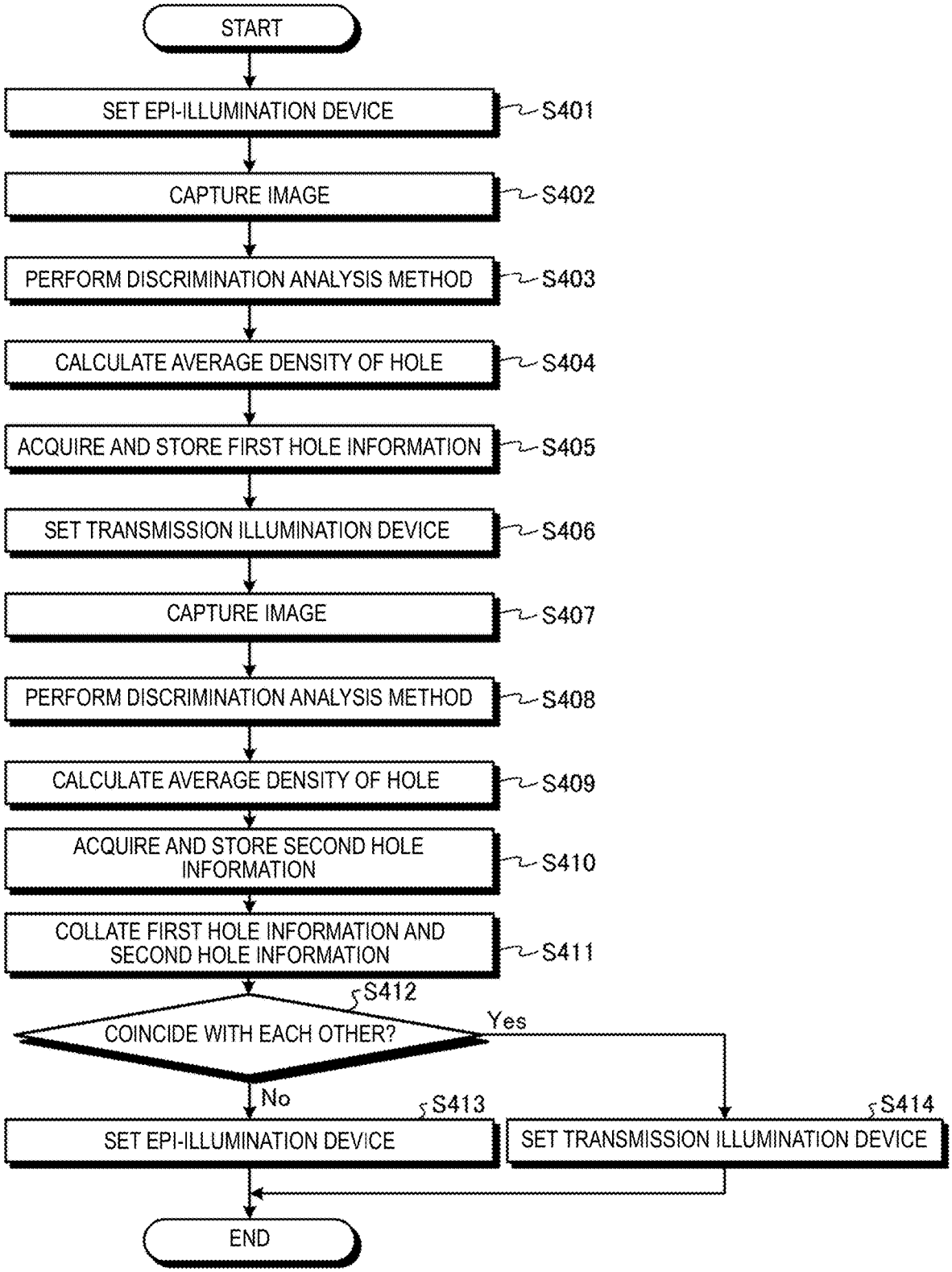
FIG. 17 is a flowchart illustrating an example of an illumination adjustment method according to the second embodiment.

The sewing machine 1 according to the embodiment will be described with reference to FIGS. 16 and 17. FIG. 16 is a schematic view illustrating an example of the sewing machine 1 according to the embodiment. FIG. 17 is a flowchart illustrating an example of the illumination adjustment method according to the embodiment. A basic configuration of the sewing machine 1 is the same as that of the sewing machine 1 according to the first embodiment described above. In the following description, the same components as those of the sewing machine 1 will be denoted by the same reference sings or corresponding reference signs, and the detailed description thereof will be omitted. The sewing machine 1 is different from that of the first embodiment in that it includes a transmission illumination device 34.

The transmission illumination device 34 is disposed on the table 2 below the imaging device 30 and below the holding member 15. The transmission illumination device 34 illuminates at least the imaging region FA of the imaging device 30 from below. The transmission illumination device 34 is a panel type illumination device. In the transmission illumination device 34, when the workpiece S is viewed from the surface, the hole 7 becomes a high luminance region, and the surface material 4 becomes a low luminance region.

When the transmission illumination device 34 is used, it is desirable to cover the imaging region FA of the imaging device 30 with a cylindrical cover, which is not illustrated, in order to suppress the influence of disturbance light.

Next, the illumination adjustment method according to the embodiment will be described with reference to FIG. 17. The illumination setting unit 73 sets the epi-illumination device 33 (step S401). The light amount of the epi-illumination device 33 is set based upon the light amount data included in the initial position data.

The illumination setting unit 73 causes the imaging device 30 to capture the image of the workpiece S held by the holding member 15 (step S402).

The illumination setting unit 73 performs the discrimination analysis method (step S403). In the discrimination analysis method, the image processing is performed on the image data obtained by capturing the surface of the workpiece S, and the surface material 4 and the hole 7 of the workpiece S are discriminated. In the embodiment, the surface material 4 can be discriminated as the low luminance region, and the hole 7 can be discriminated as the high luminance region. Further, when the hole 7 cannot be appropriately recognized by the discrimination analysis method, the illumination setting unit 73 may determine the hole 7 based upon the sewing data generated from the CAD data.

The illumination setting unit 73 calculates the average density of the region discriminated as the hole 7 of the workpiece S by the discrimination analysis method (step S404).

The illumination setting unit 73 acquires and stores the calculated average density of the holes 7 of when using the epi-illumination device 33 as first hole information (step S405).

The illumination setting unit 73 sets the transmission illumination device 34 (step S406). The light amount of the transmission illumination device 34 is set based upon the light amount data included in the initial position data.

The illumination setting unit 73 causes the imaging device 30 to capture the image of the workpiece S held by the holding member 15 (step S407).

The illumination setting unit 73 performs the discrimination analysis method (step S408).

The illumination setting unit 73 calculates the average density of the region discriminated as the hole 7 of the workpiece S by the discrimination analysis method (step S409).

The illumination setting unit 73 acquires and stores the calculated average density of the holes 7 of when using the transmission illumination device 34 as second hole information (step S410).

The illumination setting unit 73 collates the first hole information and the second hole information (step S411). When the first hole information and the second hole information coincide with each other (Yes in step S411), the illumination setting unit 73 proceeds to step S414. When the first hole information and the second hole information do not coincide with each other (No in step S411), the illumination setting unit 73 proceeds to step S413.

The illumination setting unit 73 sets the epi-illumination device 33 as illumination to be used (step S413).

The illumination setting unit 73 sets the transmission illumination device 34 as illumination to be used (step S414).

As described above, in the embodiment, it is possible to appropriately set whether to use the epi-illumination device 33 or the transmission illumination device 34. In the embodiment, when the transmission illumination device 34 is used, a change in the image caused by the color of the surface material 4 of the workpiece S, the presence or absence of wrinkles on the surface, and the thread color can be suppressed from affecting a recognition result. In other words, according to the embodiment, appropriate recognition is enabled by using the transmission illumination device 34 regardless of the color of the surface material 4, the presence or absence of wrinkles on the surface, and the thread color.

Third Embodiment

Figure 18:
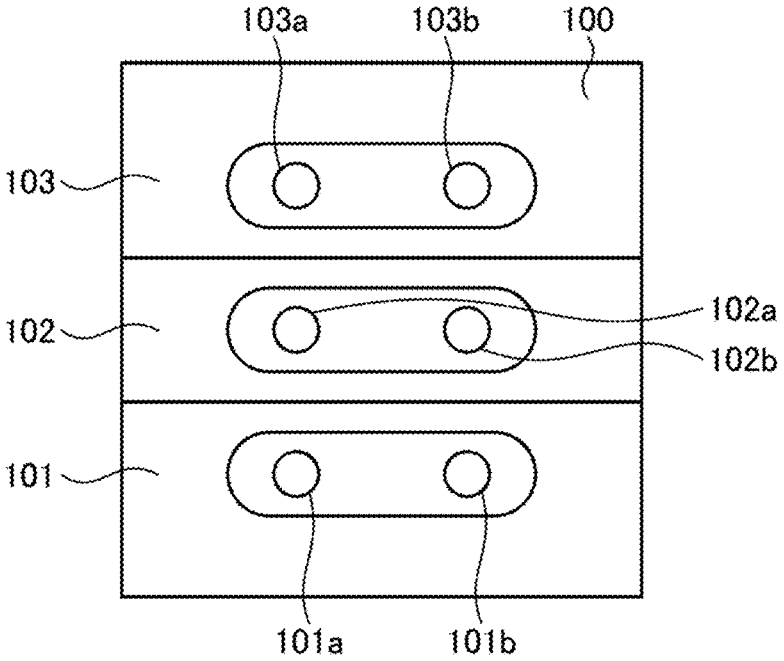
FIG. 18 is a plan view illustrating an example of a jig according to a third embodiment.
Figure 19:
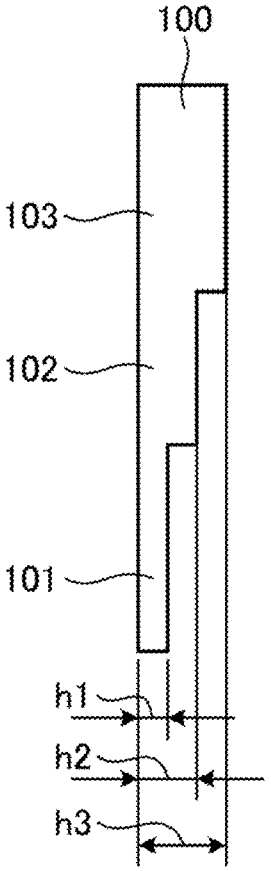
FIG. 19 is a cross-sectional view illustrating an example of the jig according to the third embodiment.
Figure 22:
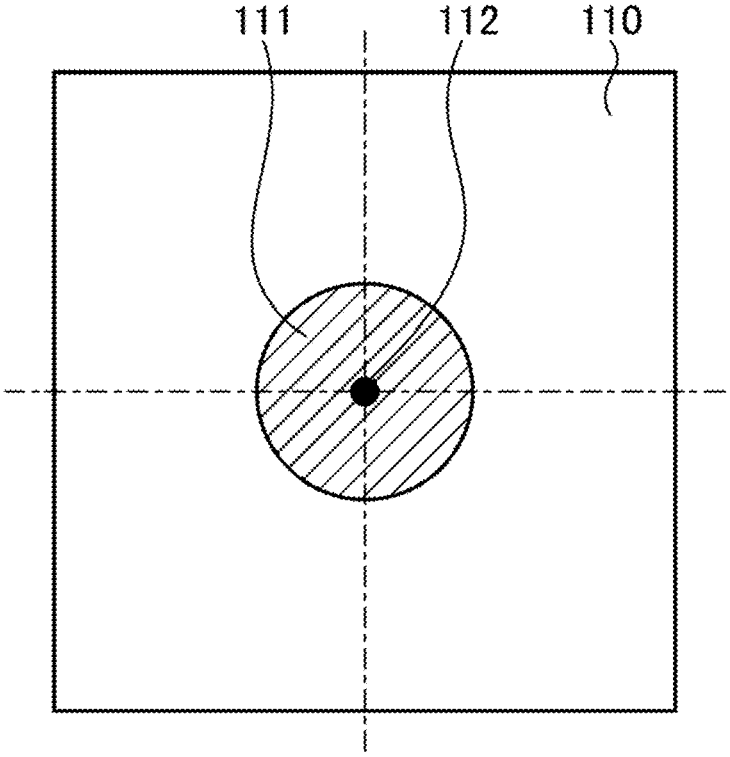
FIG. 22 is a plan view illustrating an example of the jig according to the third embodiment.
Figure 23:
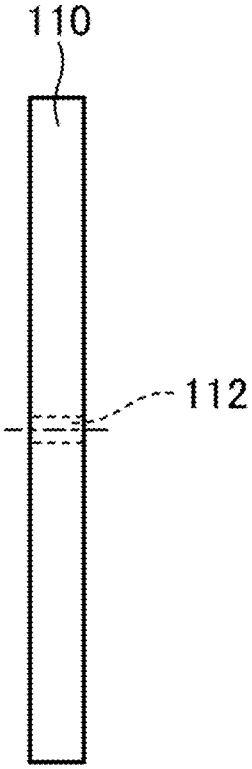
FIG. 23 is a cross-sectional view illustrating an example of the jig according to the third embodiment.
Figure 24:
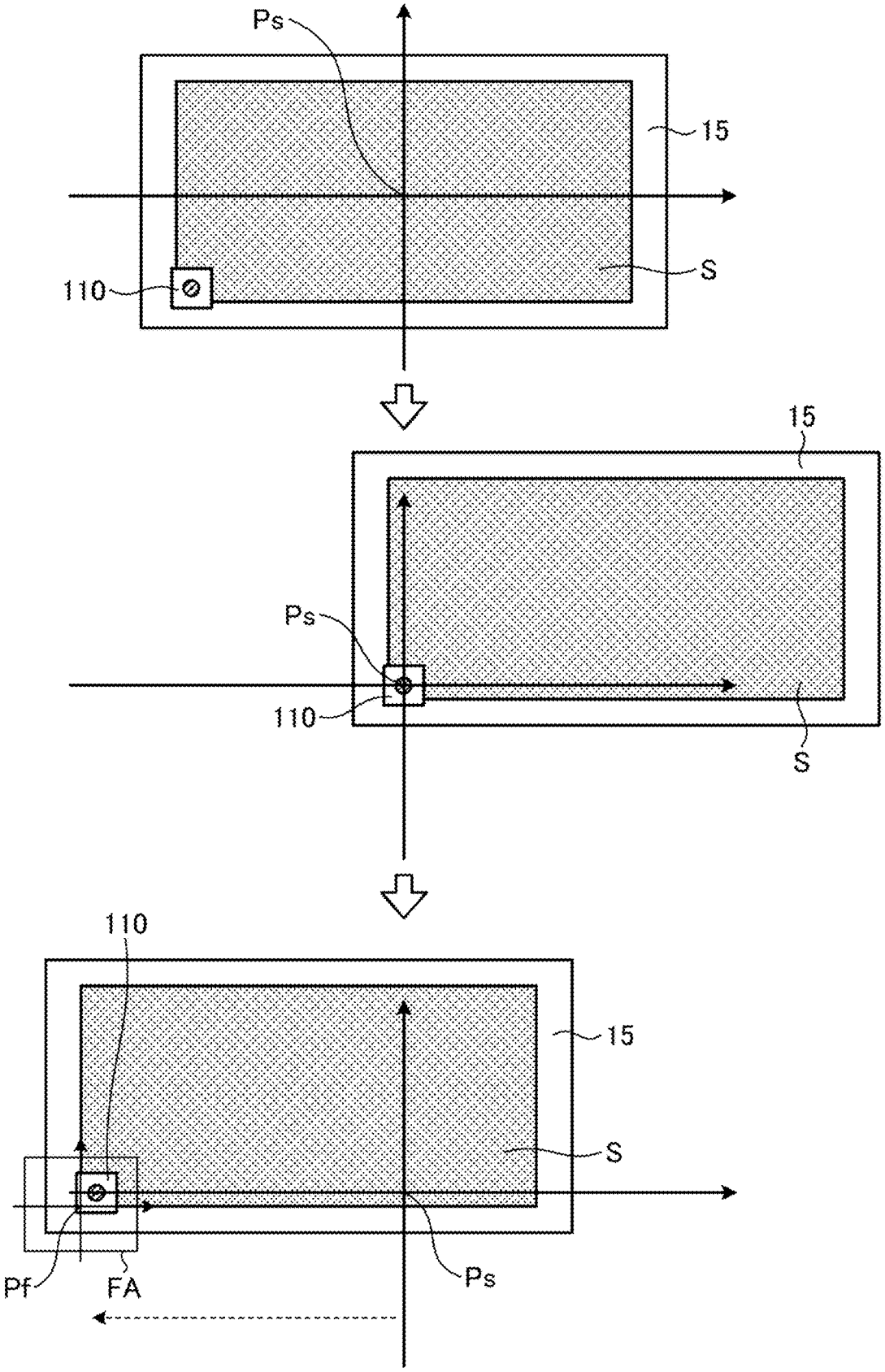
FIG. 24 is a schematic view illustrating an example of how to use the jig according to the third embodiment.
Figure 25:
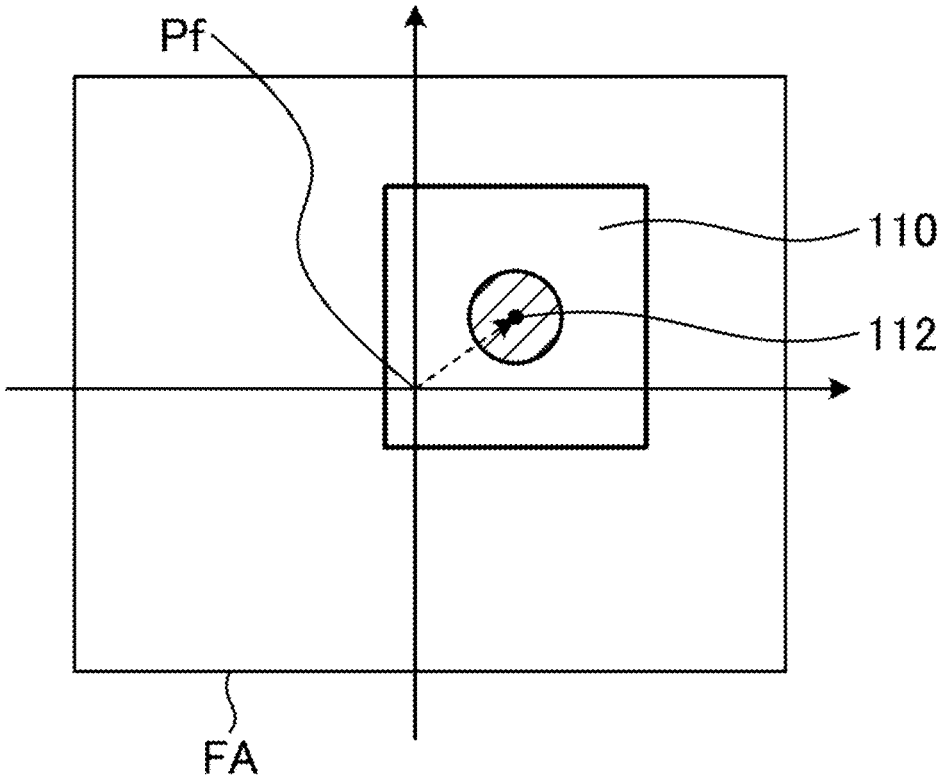
FIG. 25 is a schematic view illustrating an example of how to use the jig according to the third embodiment.
Figure 26:
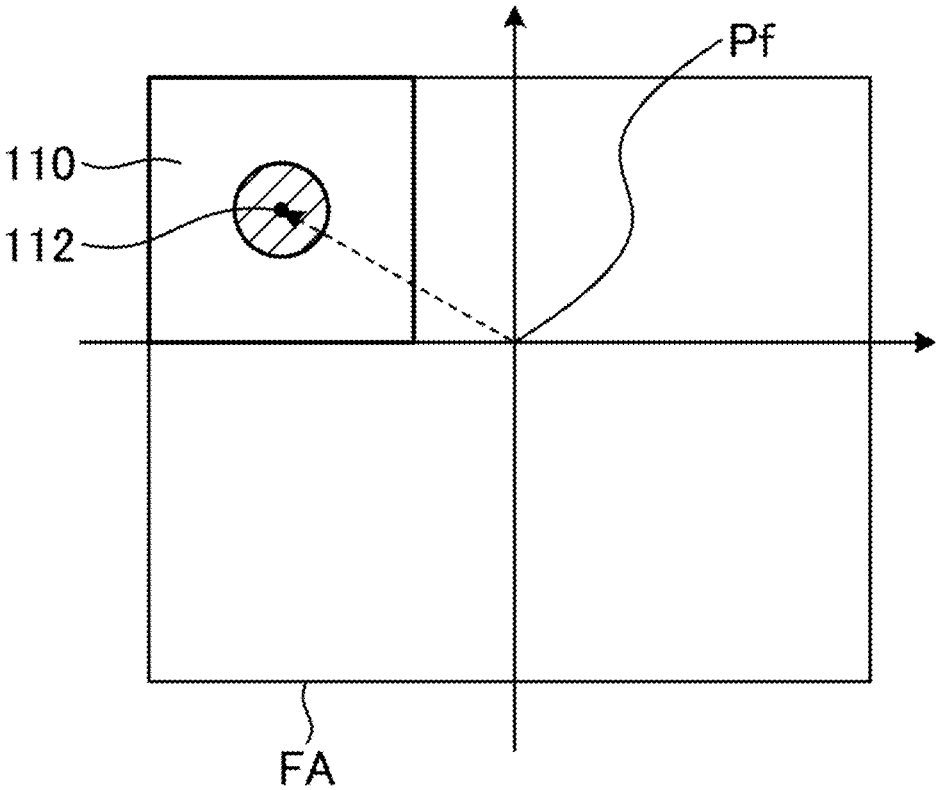
FIG. 26 is a schematic view illustrating an example of how to use the jig according to the third embodiment.

A jig 100 and a jig 110 used for calibration of the imaging device 30 of the sewing machine 1 according to the embodiment will be described with reference to FIGS. 18 to 26. FIG. 18 is a plan view illustrating an example of the jig 100 according to the embodiment. FIG. 19 is a cross-sectional view illustrating an example of the jig 100 according to the embodiment. FIG. 20 is a view illustrating an example of a pixel rate with respect to a height. FIG. 21 is a view illustrating an example of the height of the workpiece defined for each pattern. FIG. 22 is a plan view illustrating an example of the jig 110 according to the embodiment. FIG. 23 is a cross-sectional view illustrating an example of the jig 110 according to the embodiment. FIG. 24 is a schematic view illustrating an example of how to use the jig 110 according to the embodiment. FIG. 25 is a schematic view illustrating an example of how to use the jig 110 according to the embodiment. FIG. 26 is a schematic view illustrating an example of how to use the jig 110 according to the embodiment.

The jig 100 will be described with reference to FIGS. 18 and 19. The jig 100 is a jig for calculating an accurate pixel rate for each thickness of the workpiece S. The jig 100 has a thickness of three stages. The jig 100 includes a first thickness part 101 having a thickness h1, a second thickness part 102 having a thickness h2 thicker than the thickness h1, and a third thickness part 103 having a thickness h3 thicker than the thickness h2. In the first thickness part 101, a circle 101*a* and a circle 101*b* are disposed on the surface thereof. In the second thickness part 102, a circle 102*a* and a circle 102*b* are disposed on the surface thereof. In the third thickness part 103, a circle 103*a* and a circle 103*b* are disposed on the surface thereof. The circle 101*a*, the circle 101*b*, the circle 102*a*, the circle 102*b*, the circle 103*a*, and the circle 103*b* have the same size. The centers of the circle 101*a*, the circle 102*a*, and the circle 103*a* are positioned on the same straight line. The centers of the circle 101*b*, the circle 102*b*, and the circle 103*b* are positioned on the same straight line. An actual distance between the centers on the surfaces of the circles 101*a* and 101*b*, the circles 102*a* and 102*b*, and the circles 103*a* and 103*b* is the same.

The image processing is performed on the image data captured by the imaging device 30 and a distance between the centers of the circles 101*a* and 101*b*, the circles 102*a* and 102*b*, and the circles 103*a* and 103*b* on the image is calculated, thereby calculating a three-stage pixel rate.

The pixel rate will be described with reference to FIGS. 20 and 21. As illustrated in FIG. 20, a regression line is acquired based upon the three-stage pixel rate acquired by using the jig 100. Based upon the regression line, it is possible to calculate an appropriate pixel rate of the workpiece S of any thickness as illustrated in FIG. 21. As illustrated in FIG. 21, the thickness of the workpiece S is defined for each pattern. Alternatively, calculation processing may be simplified by using an intermediate value between two points based upon the three-stage pixel rate.

The jig 110 will be described with reference to FIGS. 22 and 23. The jig 110 is a jig for correcting correspondence between a sewing machine coordinate system and a camera coordinate system in a state where the holding member 15 is used. The jig 110 is a square plate material. The jig 110 includes a circular part 111 disposed at the center and a hole 112 formed at the center of the circular part 111. The circular part 111 is colored in a color different from other parts of the jig 110. The hole 112 is the center of gravity of the jig 110. The jig 110 can accurately detect a position by gravity center calculation.

A method of using the jig 110 will be described with reference to FIGS. 24 to 26. First, the jig 110 is fixed at an arbitrary position on the holding member 15 as illustrated in FIG. 24. Then, as illustrated in the center of FIG. 24, the holding member 15 is moved to a sewing machine original point immediately below the needle 3 to store a sewing machine coordinate value. Then, as illustrated in FIG. 24, the holding member 15 is moved immediately below the imaging device 30, and a coordinate value of the center of gravity of the jig 110 is detected based upon the captured image. Further, as illustrated in FIG. 25, the coordinate value of the center of the imaging device 30 in the sewing machine coordinate system is acquired from a movement amount in the X-axis direction and a movement amount in the Y-axis direction acquired from the driving amount of the actuator 17, and the coordinate value of the center of gravity of the jig 110. As illustrated in FIG. 26, the table 2 is moved in the horizontal plane by a known amount in the X-axis direction and the Y-axis direction, and the coordinate value of the center of gravity of the jig 110 is detected again. The camera coordinate system, the sewing machine coordinate system, and an inclination θ can be calculated based upon the detected coordinate values of the two centers of gravity and the movement amount of the table 2. In this manner, the correspondence between the sewing machine coordinate system and the camera coordinate system can be corrected.

As described above, the embodiment can appropriately calculate the pixel rate corresponding to the thickness of the workpiece S. In addition, in the state where the holding member 15 is used, the embodiment can accurately acquire a positional relationship between the imaging device 30 and the workpiece S in the sewing machine coordinate system. In the embodiment, the displacement generated on the surface of the workpiece S can be detected with high accuracy regardless of the thickness of the workpiece S.

The invention claimed is:

1. A sewing machine, comprising:

a holding member configured to be movable while holding a workpiece within a predetermined plane including a sewing position immediately below a needle;

an actuator configured to move the holding member;

a camera configured to capture image data of the workpiece;

a computer configured to acquire sewing data including a sewing order to be referred to in sewing processing, and the computer configured to output a control signal to the actuator so that a plurality of feature patterns of the workpiece are sequentially disposed in an imaging region of the camera based upon the sewing data and a current imaging position of the workpiece captured by the camera; and an operation unit configured to be displayed by the computer, wherein the sewing data includes:

position data of a correction point for correcting displacement of a surface of the workpiece;

position data of an imaging position of a feature pattern of the plurality of feature patterns captured by the camera for calculating a displacement amount of the correction point; and an idle feeding amount for moving the correction point to the imaging region, and wherein when an operation to the operation unit is detected, the computer outputs the control signal to the actuator so that the holding member is moved by the idle feeding amount.

2. The sewing machine according to claim 1, wherein the computer outputs the control signal so that the plurality of feature patterns are sequentially disposed in the imaging region in order or in reverse order, corresponding to the sewing order.

3. The sewing machine according to claim 1, further comprising:

a display configured to display the image data captured by the camera, wherein the computer is further configured to set a position of a template frame of a feature pattern of the plurality of feature patterns and an imaging position thereof on the image data displayed on the display.

4. A sewing machine, comprising:

a holding member configured to be movable while holding a workpiece within a predetermined plane including a sewing position immediately below a needle;

an actuator configured to move the holding member;

a camera configured to capture image data of the workpiece;

a light configured to illuminate the workpiece captured by the camera;

an operation panel configured to receive an operation related to adjusting a light amount of the light; and a computer configured to output a control signal for controlling the light amount of the light depending on a color of a surface of the workpiece based upon the operation received at the operation panel, wherein the computer is further configured to generate initial position data indicating an initial position of a plurality of feature patterns of the workpiece based upon image data captured by the camera, and wherein the initial position data defines light amount data of the light for each workpiece, and the light amount data includes the light amount and a binarization threshold value.

5. A sewing method, comprising:

capturing, by a camera, image data of a workpiece held by a holding member which is movable within a predetermined plane including a sewing position immediately below a needle;

acquiring sewing data including a sewing order to be referred to in sewing processing;

outputting a control signal to an actuator which moves the holding member so that a plurality of feature patterns of the workpiece are sequentially disposed in an imaging region of the camera based upon the sewing data and a current imaging position of the workpiece captured by the camera; and displaying an operation unit, wherein the sewing data includes:

position data of a correction point for correcting displacement of a surface of the workpiece;

position data of an imaging position of a feature pattern of the plurality of feature patterns captured by the camera for calculating a displacement amount of the correction point; and an idle feeding amount for moving the correction point to the imaging region, and wherein when an operation to the operation unit is detected, the control signal is output to the actuator so that the holding member is moved by the idle feeding amount.

6. A sewing method, comprising:

capturing, by a camera, image data of a workpiece held by a holding member which is movable within a predetermined plane including a sewing position immediately below a needle;

receiving, by an operation panel, an operation with respect to adjusting a light amount of a light which illuminates the workpiece captured by the camera;

outputting a control signal for controlling the light amount of the light depending on a color of a surface of the workpiece based upon the operation received at the operation panel; and generating initial position data indicating an initial position of a plurality of feature patterns of the workpiece based upon image data captured by the camera, wherein the initial position data defines light amount data of the light for each workpiece, and the light amount data includes the light amount and a binarization threshold value.

* * * * *